US009126796B2

(12) United States Patent
Takahashi

(10) Patent No.: US 9,126,796 B2
(45) Date of Patent: Sep. 8, 2015

(54) SYSTEM FOR CONTROLLING SHEET FOLDING PROCESSING

(71) Applicant: CANON KABUSHIKI KAISHA, Tokyo (JP)

(72) Inventor: Yasuhiro Takahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/062,116

(22) Filed: Oct. 24, 2013

(65) Prior Publication Data

US 2014/0045667 A1 Feb. 13, 2014

Related U.S. Application Data

(63) Continuation of application No. 12/293,327, filed as application No. PCT/JP2008/050663 on Jan. 15, 2008, now Pat. No. 8,600,287.

(30) Foreign Application Priority Data

Jan. 15, 2007 (JP) ..... 2007-006419

(51) Int. Cl.
*G03G 15/00* (2006.01)
*B65H 45/04* (2006.01)
*B65H 45/14* (2006.01)

(52) U.S. Cl.
CPC ..... *B65H 45/04* (2013.01); *B65H 45/142* (2013.01)

(58) Field of Classification Search
CPC ..... G03G 2215/0087; G03G 2215/0487; G03G 2215/00417; G03G 9/0815; B65H 45/04; B65H 45/142
USPC ..... 399/407–408, 397, 365, 370, 376
See application file for complete search history.

(56) References Cited

U.S. PATENT DOCUMENTS

| | | | |
|---|---|---|---|
| 5,192,977 | A | 3/1993 | Kaneko et al. |
| 5,434,661 | A | 7/1995 | Takahashi et al. |
| 5,492,315 | A | 2/1996 | Maruyama et al. |
| 5,540,421 | A | 7/1996 | Ohta et al. |
| 5,569,011 | A | 10/1996 | Yamaguchi et al. |

(Continued)

FOREIGN PATENT DOCUMENTS

| | | | |
|---|---|---|---|
| JP | 2001-117430 | A | 4/2001 |
| JP | 2006-193288 | A | 7/2006 |
| JP | 2006-349927 | A | 12/2006 |

OTHER PUBLICATIONS

International Search Report and Written Opinion in PCT/JP2008/050663, filed Jan. 15, 2008.

(Continued)

*Primary Examiner* — Matthew G Marini
(74) *Attorney, Agent, or Firm* — Fitzpatrick, Cella, Harper & Scinto

(57) ABSTRACT

There is a disclosure of a system which controls a folding unit performing folding processing to one set of sheets supplied by a print unit. The one set of sheets includes sheets of a first size and/or a second size which is smaller than the first size. The system includes a first controller and second controller. When the one set of sheets includes a sheet of the first size, the first controller inhibits the folding processing to a sheet of the second size. When the one set of sheets does not include a sheet of the first size but includes a sheet of the second size, the second controller permits the folding processing to a sheet of the second size.

16 Claims, 25 Drawing Sheets

(56) References Cited

U.S. PATENT DOCUMENTS

| | | | | |
|---|---|---|---|---|
| 5,569,012 | A | | 10/1996 | Kosasa et al. |
| 5,752,154 | A | | 5/1998 | Maruyama et al. |
| 5,768,677 | A | * | 6/1998 | Natsume ..... 399/376 |
| 5,907,744 | A | * | 5/1999 | Yamashita et al. ..... 399/85 |
| 5,993,369 | A | | 11/1999 | Sekita et al. |
| 6,851,666 | B2 | | 2/2005 | Nagao et al. |
| 2006/0012098 | A1 | | 1/2006 | Kaneko |

OTHER PUBLICATIONS

Office Action, dated Oct. 21, 2011, in counterpart Japanese Patent Application No. 2007-006419.

* cited by examiner

110
EXPANSION CONNECTOR
124
HD
162
HD DRIVE
160
IDE CONNECTOR
161
BACKUP BATTERY
134
REAL-TIME CLOCK MODULE
133
125
I/O CONTROLLER
SERIAL COMMUNICATION CONTROLLERS
126
127
LCD CONTROLLER
131
PANEL I/F
132
130
CONNECTOR
122
NETWORK CONTROLLER
121
123
SRAM
119
Codec
118
120
DRAM
116
CPU
112
117
MAIN CONTROLLER
111
BUS CONTROLLER
113
ROM
114
115
GRAPHIC ENGINE
135
SRAM
136
146
141
128
PRINTER I/F
145
148
149
CON-NEC-TOR
147
SCANNER I/F
140
143
144
CON-NEC-TOR
142

SYSTEM FOR CONTROLLING SHEET FOLDING PROCESSING

This is a continuation of U.S. patent application Ser. No. 12/293,327, filed Sep. 17, 2008, which is a National Stage Entry of International Application No. PCT/JP2008/050663, filed Jan. 15, 2008.

TECHNICAL FIELD

The present invention relates to controlling sheet folding processing.

BACKGROUND ART

There is proposed a sheet processing apparatus which performs post-processing such as folding processing to sheets printed by a printing apparatus (Japanese Patent Laid-Open No. 2006-193288).

According to this proposal, when folding sheets of different sizes, the user cannot determine the size of a sheet to be folded and that of a sheet not to be folded. The user cannot obtain an output result he wants.

The conventional sheet processing apparatus cannot process various types of jobs such as a job (to be referred to as a mixed size job) requiring sheets of different sizes in print processing of one set, and a job (to be referred to as an equal-size job) requiring sheets of the same size in print processing of one set.

DISCLOSURE OF INVENTION

The present invention allows realization of flexibly meeting a variety of needs from the user in association with post-processing to sheets.

According to the present invention, the foregoing problem is solved by providing a system adapted to enable a folding unit to perform folding processing for one set of sheets supplied by a print unit, the one set of sheets including a sheet of a first size and/or second size which is smaller than the first size, the system comprising:

a first controller adapted to inhibit the folding processing to a sheet of the second size included in one set of sheets, when the one set of sheets includes a sheet of the first size; and a second controller adapted to permit the folding processing to a sheet of the second size, when the one set of sheets does not include a sheet of the first size but includes a sheet of the second size.

According to another aspect of the present invention, a program product comprising a computer usable storage medium including a program code for causing a computer system to perform a method for enabling a folding unit to perform folding processing for one set of sheets supplied by a print unit, the one set of sheets including a sheet of a first size and/or second size which is smaller than the first size, the method comprising:

inhibiting the folding processing to a sheet of the second size included in one set of sheets, when the one set of sheets includes a sheet of the first size; and permitting the folding processing to a sheet of the second size, when the one set of sheets does not include a sheet of the first size but includes a sheet of the second size.

Further features of the present invention will be apparent from the following description of exemplary embodiments with reference to the attached drawings.

BEST MODE FOR CARRYING OUT THE INVENTION

A preferred embodiment of the present invention will now be described in detail with reference to the drawings. It should be noted that the relative arrangement of the components, the numerical expressions and numerical values set forth in these embodiments do not limit the scope of the present invention unless it is specifically stated otherwise. In this specification, the term "size" includes not only the area but also the shape.

Hence, "sizes are different" can be rewritten into "shapes and/or areas are different". In the following embodiment, "print sheet" is not limited to paper, and the present invention is applicable to any foldable "sheet". In this specification, "Z-folding" is a sheet folding style also called "accordion folding". This sheet folding style includes a method of folding a sheet completely in three at positions corresponding to ⅓ and ⅔ of the sheet width, and a method of folding a sheet at two positions corresponding to ¼ and ½ of the sheet width to obtain a half size.

Figure 1:
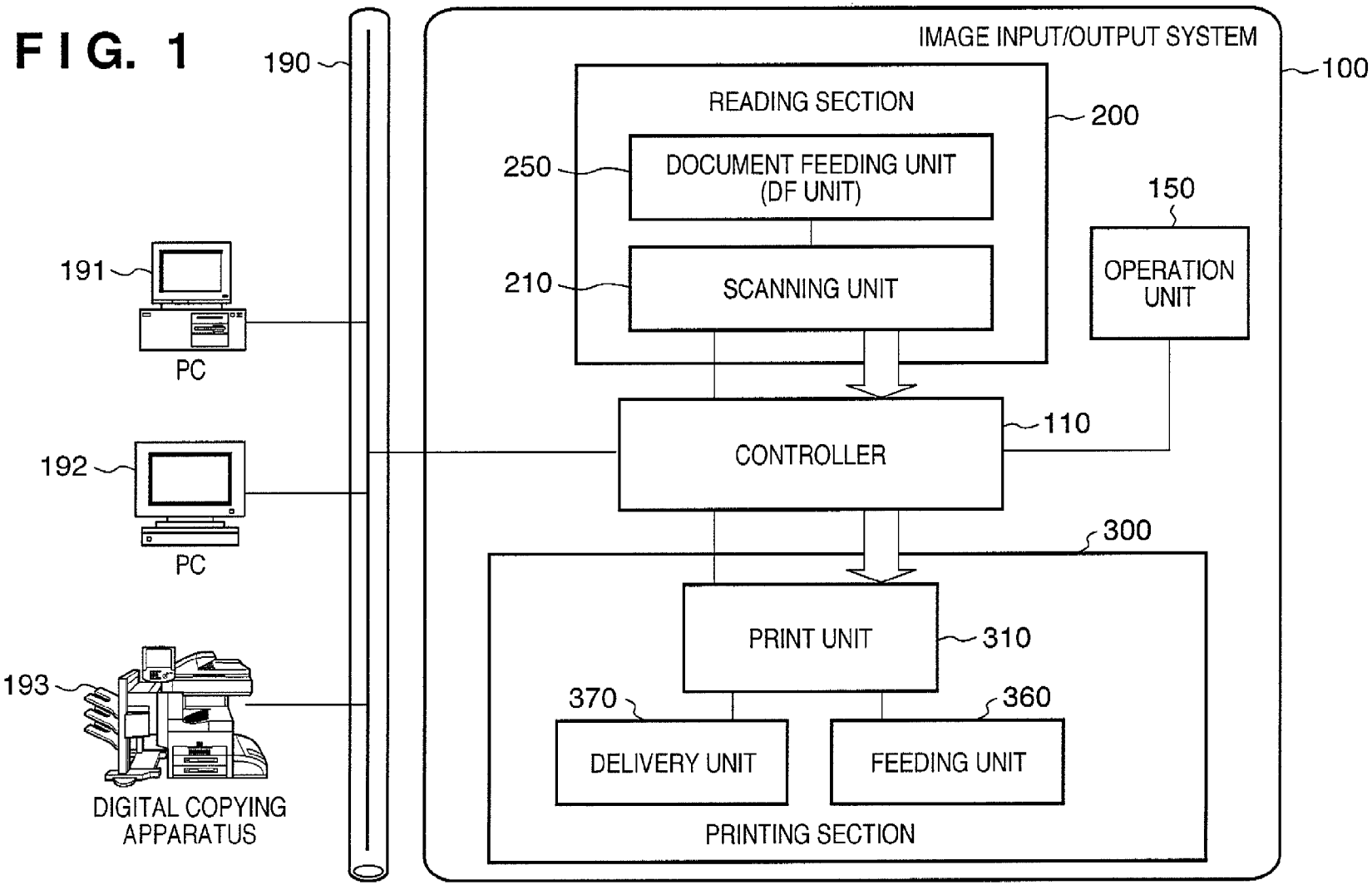
FIG. 1 is a block diagram for explaining the overall configuration of an image input/output system according to one embodiment of the present invention.

An image input/output system (printing system) will be described as an embodiment of a printing apparatus according to the present invention. FIG. 1 is a block diagram showing the internal configuration of an image input/output system 100 and a peripheral arrangement to which the image input/output system 100 is applicable.

As shown in FIG. 1, the image input/output system 100 comprises a reading section 200, printing section 300, controller 110, and operation unit 150.

The reading section 200 includes a document feeding unit 250 and scanning unit 210. The document feeding unit 250 feeds a document. The scanning unit 210 scans an image on a document fed by the document feeding unit 250. Image data scanned by the scanning unit 210 is sent to the controller 110.

The printing section 300 includes a feeding unit 360, print unit 310, and delivery unit 370. The feeding unit 360 comprises a plurality of cassettes storing print sheets of different sizes, respectively. The feeding unit 360 feeds a print sheet from each cassette. The print unit 310 electrophotographically prints an image on a print sheet. The print unit 310 receives image data via the controller 110 from the scanning unit 210 or a PC (host computer) 191 or 192 connected to a LAN 190. The print unit 310 prints an image on a print sheet fed from the feeding unit 360 on the basis of the received image data. The delivery unit 370 processes, e.g., sorts or staples print sheets on which images are printed by the print unit 310, and then delivers the sheets.

The controller 110 is electrically connected to the reading section 200 and printing section 300, and is connected to the PCs 191 and 192 and a digital copying apparatus 193 via the LAN 190. When the image input/output system 100 operates as a copying machine, the controller 110 controls the reading section 200 to send image data of a read document to the printing section 300, and controls the printing section 300 to form an image on a print sheet. When the image input/output system 100 operates as a scanner, the controller 110 can also convert image data read by the reading section 200 into code data, and transmit it to the PC 191 or 192 via the LAN 190. When the image input/output system 100 operates as a printer, the controller 110 can also convert code data received from the PC 191 or 192 via the LAN 190 into image data, and cause the printing section 300 to print based on the image data.

The operation unit 150 has a variety of keys for inputting instructions to the controller 110, and a liquid crystal display panel for displaying an interface window with the user. When the user operates any key, the operation unit 150 generates a signal corresponding to the operated key and sends it to the controller 110.

Figure 2:
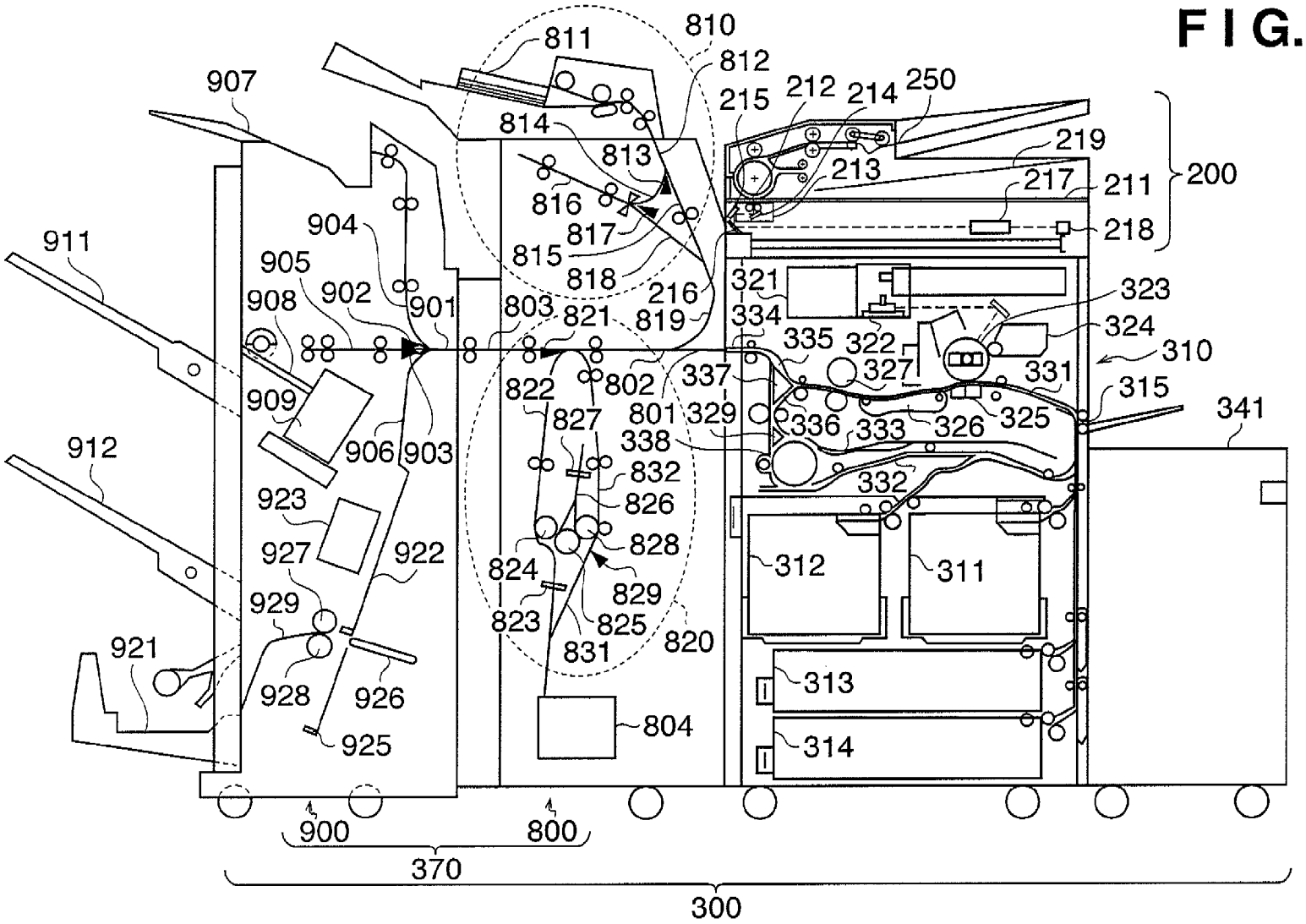
FIG. 2 is a sectional view schematically showing the hardware configurations of a reading section 200 and printing section 300.

The hardware configurations of the reading section 200 and printing section 300 will be explained with reference to FIG. 2. FIG. 2 is a schematic view showing the hardware configurations of the reading section 200 and printing section 300.

The reading section 200 and printing section 300 are configured as shown in FIG. 2. The printing section 300 is connected to a deck unit 341, a C/Z-folding unit 800 serving as a sheet folding unit, and a finisher 900. The C/Z-folding unit 800 and finisher 900 constitute the delivery unit 370.

The image reader, print unit, C/Z-folding unit, and finisher will be described.

<Reading Section>

The reading section 200 comprises the document feeding unit 250. The document feeding unit 250 feeds document sheets one by one sequentially from the first sheet onto a platen glass 211. Every time the reading operation of each document sheet ends, the document sheet is discharged from the platen glass 211 onto a discharge tray 219. In the reading section 200, after a document sheet is fed onto the platen glass 211, a lamp 212 is turned on, and a scanning box 213 starts moving. As the scanning box 213 moves, the document sheet on the platen glass 211 is read and scanned. During read scanning, reflected light from the document sheet is guided to a CCD image sensor (to be referred to as a CCD hereinafter) 218 via mirrors 214, 215, and 216 and a lens 217. The image on the document sheet is formed on the image sensing plane of the CCD 218. The CCD 218 converts the image formed on the image sensing plane into an electrical signal, and sends the electrical signal as image data to the controller 110.

<Printing Section>

The printing section 300 comprises a laser driver 321. The laser driver 321 drives a laser emitting portion 322 on the basis of image data sent from the controller 110. The laser emitting portion 322 emits a laser beam corresponding to image data. The laser beam is reflected by a rotary polygon mirror (not shown) and scans the surface of a photosensitive drum 323. An electrostatic latent image corresponding to the emitted laser beam is formed on the surface of the photosensitive drum 323. The electrostatic latent image on the photosensitive drum 323 is visualized as a toner image with toner supplied from a developing unit 324. In synchronism with the laser beam irradiation timing, a print sheet is fed between the photosensitive drum 323 and a transfer portion 325 via a conveyance path 331 from a cassette 311, 312, 313, or 314, a manual feed stage 315, or the deck unit 341. The toner image on the photosensitive drum 323 is transferred onto the fed print sheet at the transfer portion 325.

The print sheet bearing the toner image is sent to a fixing portion 327 by a conveyance belt 326. The fixing portion 327 thermally presses the print sheet to fix the toner image on the print sheet onto it. The print sheet having passed through the fixing portion 327 is sent from a delivery port 334 into the C/Z-folding unit 800 via a conveyance path 335. As the delivery unit 370 for print sheets, a delivery bin can also be attached outside the delivery port 334, instead of the C/Z-folding unit 800 and finisher 900. Print sheets can be discharged to the delivery bin. To send a print sheet to the C/Z-folding unit after reversing the print surface, the print sheet is temporarily guided from a conveyance path 336 to a conveyance path 338 via a flapper 329, and then sent from the delivery port 334 to the C/Z-folding unit via a conveyance path 337. When the two-sided printing mode is set, a print sheet having passed through the fixing portion 327 is guided to the conveyance path 336, temporarily guided to a conveyance path 333 via the flapper 329, and then guided to a conveyance path 332 via the conveyance path 338. The print sheet guided to the conveyance path 332 is fed again between the photosensitive drum 323 and the transfer portion 325, and a toner image is transferred onto the unprinted surface of the print sheet.

<C/Z-Folding Unit>

The C/Z-folding unit 800 includes an inserter unit 810, C/Z-folding unit 820, and C-folded sheet delivery port 804. The inserter unit 810 feeds a printed sheet and inserts it into a desired position between print sheets output from the print unit 310.

The inserter unit 810 feeds a sheet set on an inserter feeding stage 811 into a conveyance path 812. A flapper 813 sends a print sheet on the conveyance path 812 to conveyance paths 815 and 819, and guides it to a conveyance path 802. Also, the flapper 813 sends a sheet fed from the inserter feeding stage 811 to conveyance paths 814 and 816. Then, the sheet is reversely fed. After the sheet set on the inserter feeding stage 811 is reversed (turned over), it can be sent to the conveyance path 819.

The C/Z-folding unit 820 can execute the following three types of processes to a sheet fed from the inserter unit and a sheet sent from the print unit:

1. pass-through mode,
2. C-folding mode, and
3. Z-folding mode.

In the "pass-through mode" out of these modes, a sheet is sent to a subsequent unit without performing C-folding (also called V-folding or single folding) or Z-folding (also called accordion folding). A sheet having passed through the conveyance path 802 is sent to the finisher 900 via a conveyance path 803.

Figure 10:
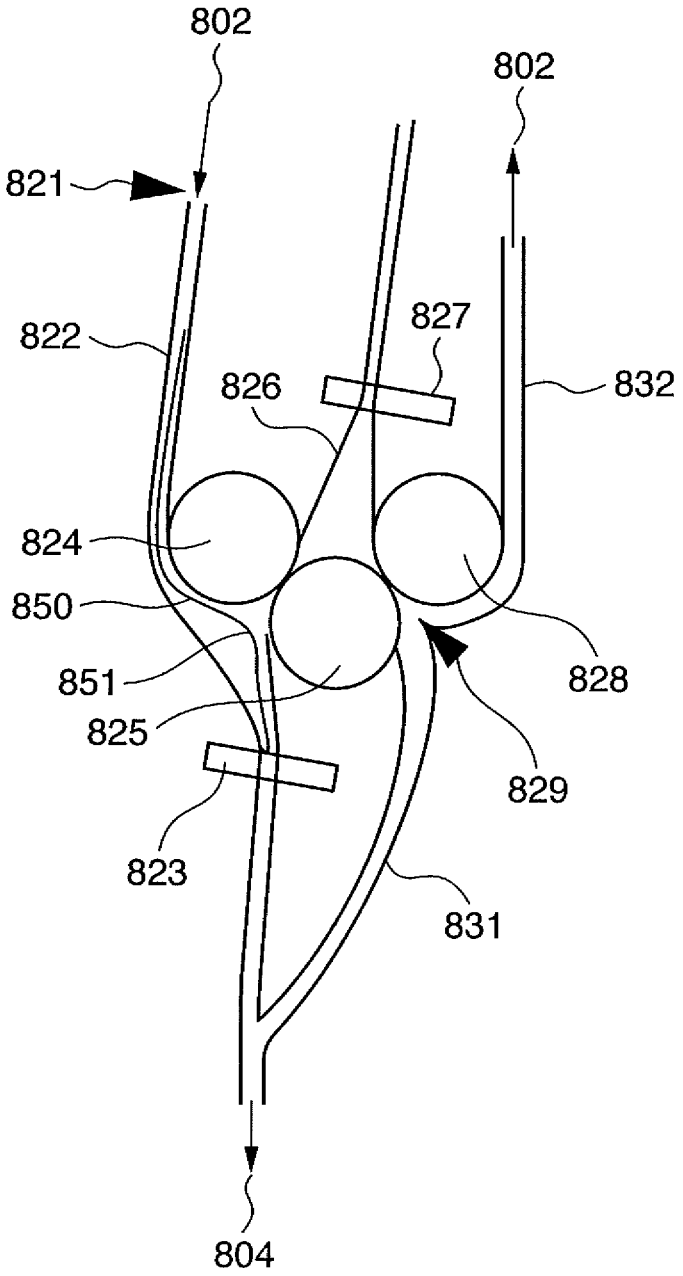
FIG. 10 is a sectional view for explaining a control example of Z-folding by the C/Z-folding unit 800.
Figure 11:
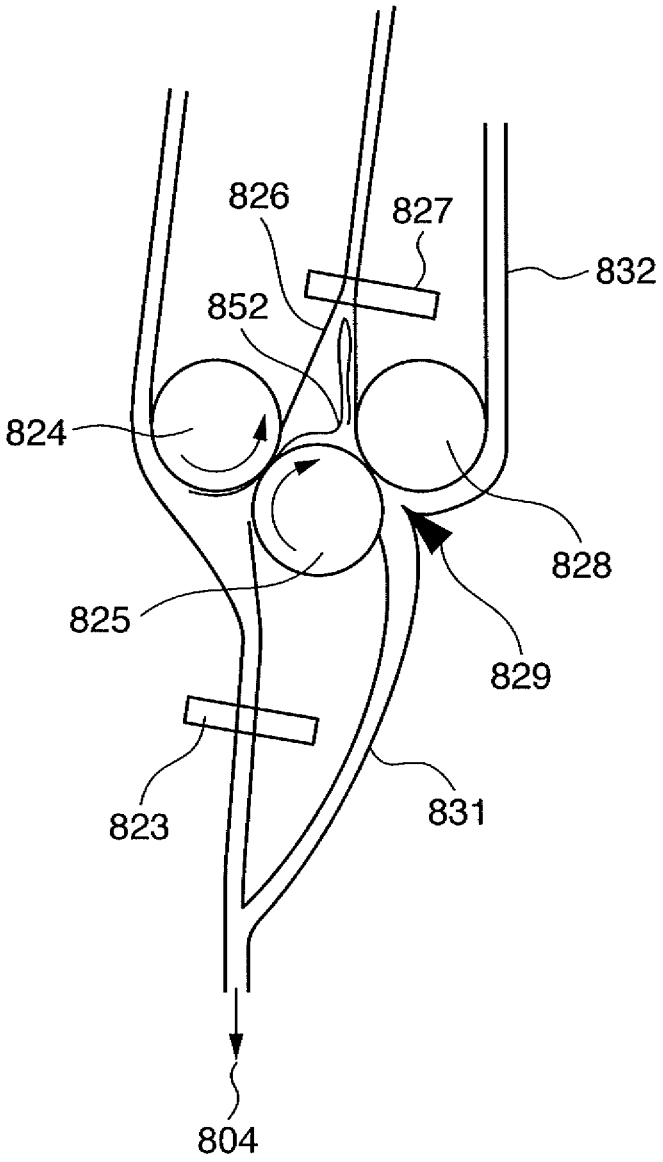
FIG. 11 is a sectional view for explaining a control example of Z-folding by the C/Z-folding unit 800.
Figure 12:
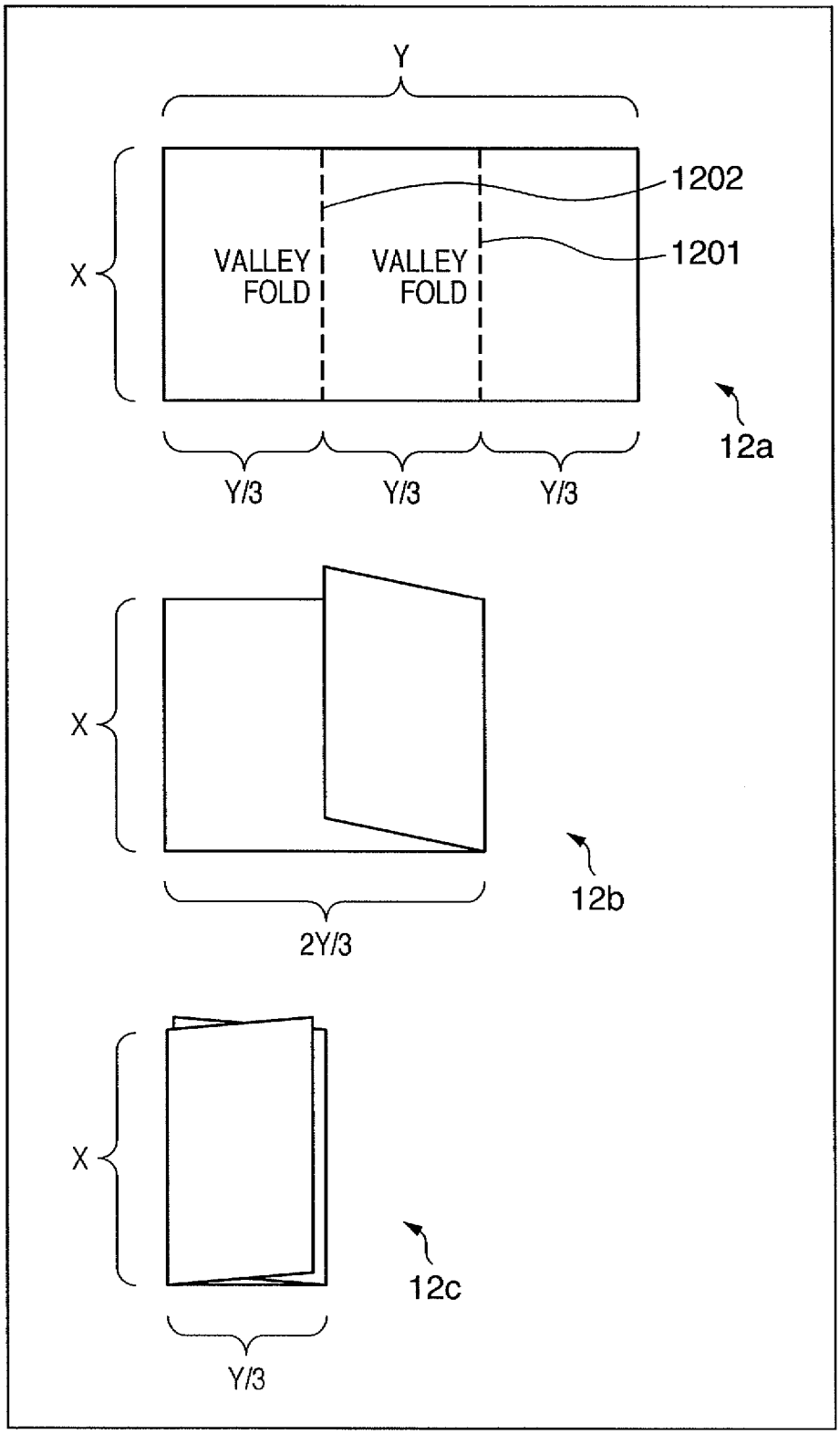
FIG. 12 is a view for explaining C-folding.
Figure 13:
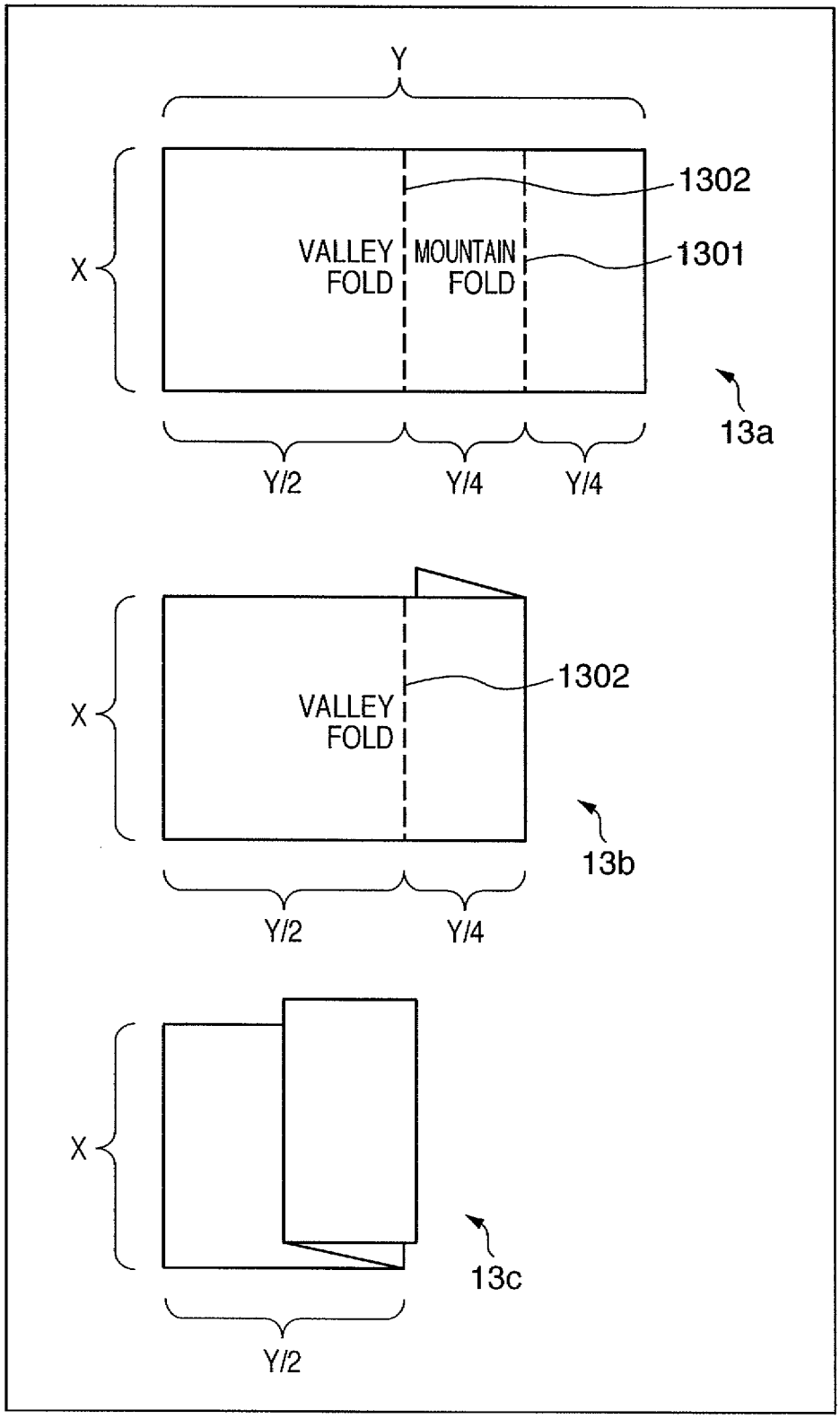
FIG. 13 is a view for explaining Z-folding.

The "C-folding mode" and "Z-folding mode" by the C/Z-folding unit 820 will be explained with reference to FIGS. 8 to 13. FIGS. 8 to 11 are sectional views showing the C/Z-folding unit 820 in detail. FIG. 12 shows procedures to fold a sheet 840 in the C-folding mode. Similarly, FIG. 13 shows procedures to fold a sheet 850 in the Z-folding mode.

Figure 8:
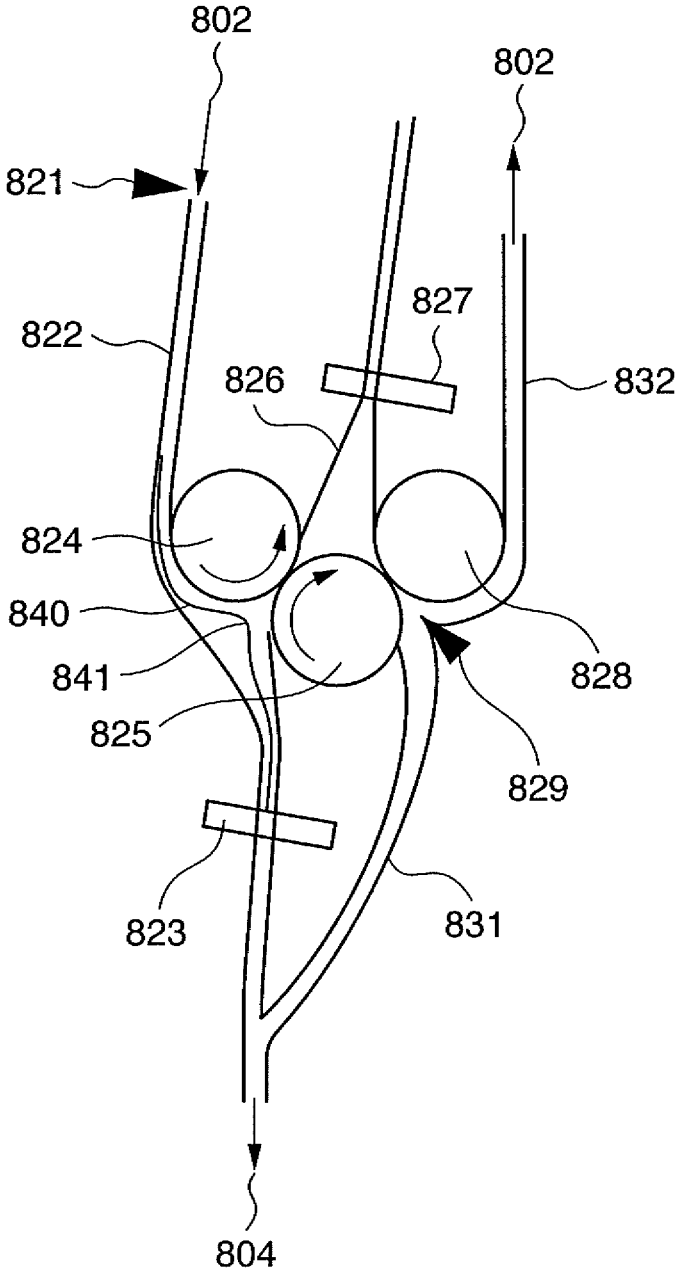
FIG. 8 is a sectional view for explaining a control example of C-folding by a C/Z-folding unit 800.

In the "C-folding mode", the sheet 840 conveyed to the C/Z-folding unit 820 via the conveyance path 802 is folded by a folding style called "C-folding", and discharged to the C-folded sheet delivery port 804. If the user designates the "C-folding mode" on the operation unit 150, a flapper 821 operates to guide the sheet 840 from the conveyance path 802 to a conveyance path 822, as shown in FIG. 8. When the leading end of the sheet 840 hits a stopper 823, a formed loop 841 of the sheet 840 is nipped between folding rollers 824 and 825.

Then, the sheet 840 (print sheet size of X×Y) shown as 12*a* in FIG. 12 is folded once at a position 1201, as shown as 12*b* in FIG. 12. The stopper 823 is arranged at a position where the distance from the nip becomes ⅔ of the sheet 840 in the Y direction.

Figure 9:
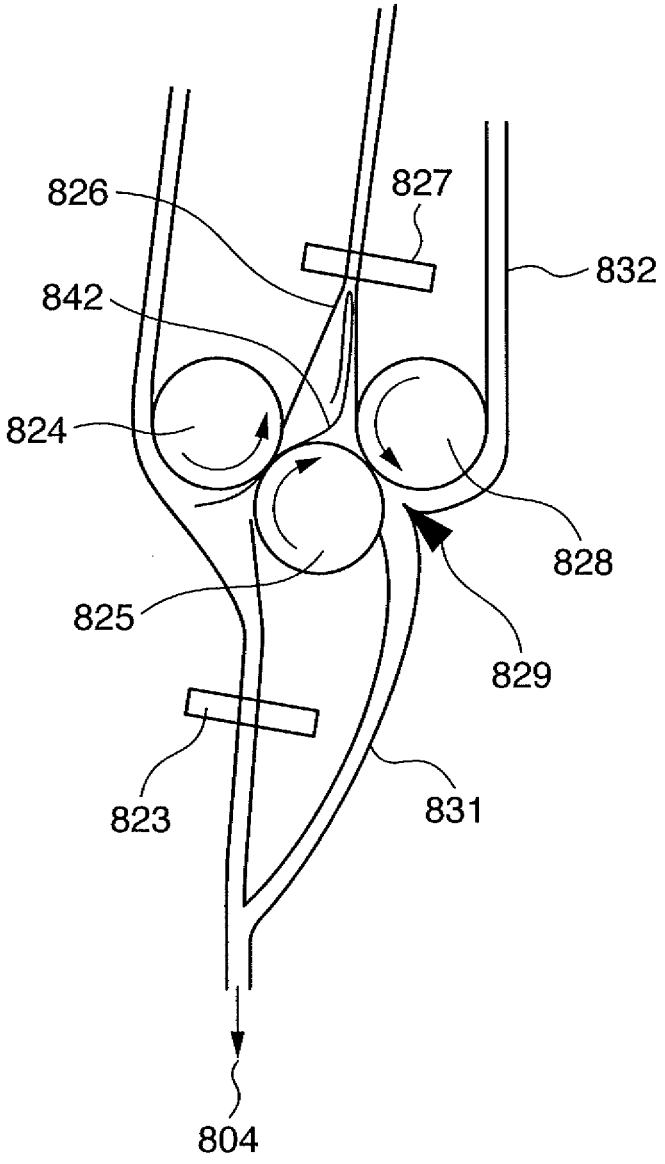
FIG. 9 is a sectional view for explaining a control example of C-folding by the C/Z-folding unit 800.

The sheet 840 folded once is guided to a conveyance path 826. When the sheet 840 hits a stopper 827, a formed loop 842 of the sheet 840 is nipped between the folding roller 825 and a folding roller 828 (FIG. 9).

The sheet 840 as 12*b* in FIG. 12 is folded again, and as a result, folded twice as shown as 12*c* in FIG. 12. The stopper 827 is arranged at a position where the distance from the nip between the rollers 825 and 828 becomes ⅓ of the sheet 840. The sheet 840 folded twice passes through a conveyance path 831 via a flapper 829, and is delivered to the C-folded sheet delivery port 804.

In the "Z-folding mode", a sheet conveyed via the conveyance path 802 is folded by a folding style called "Z-folding", and returned to the conveyance path 802. If the user designates the "Z-folding mode" on the operation unit 150, the flapper 821 operates to guide the sheet 850 from the conveyance path 802 to the conveyance path 822, as shown in FIG. 10. When the leading end of the sheet 850 hits the stopper 823, a formed loop 851 of the sheet 850 is nipped between the folding rollers 824 and 825.

Then, the sheet 850 (print sheet size of X×Y) shown as 13*a* in FIG. 13 is folded once at a position 1301, as shown as 13*b* in FIG. 13. The stopper 823 is arranged at a position where the distance from the nip becomes ¼ of the sheet 850 in the Y direction.

The sheet 850 folded once is guided to the conveyance path 826. When the sheet 850 hits the stopper 827, a formed loop 852 of the sheet 850 is nipped between the folding rollers 825 and 828 (FIG. 11).

The sheet 850 as 13*b* in FIG. 13 is folded again at a position 1302, and as a result, folded twice as shown as 13*c* in FIG. 13. At this time, the stopper 827 is arranged at a position where the length from the fold formed by the rollers 824 and 825 to the loop 852 becomes ¼ of the sheet 850. The sheet 850 folded twice returns from a conveyance path 832 to the conveyance path 802 via the flapper 829. After that, the sheet 850 is sent to the finisher 900 via the conveyance path 803.

<Finisher>

Referring back to FIG. 2, the finisher 900 includes a sample tray 907, stack trays 911 and 912, and a booklet tray 921. The finisher 900 can perform processing such as stapling, sorting, offset, or bookbinding, and deliver processed sheets.

When outputting a sheet to the sample tray 907, a sheet coming into a conveyance path 901 is delivered to the sample tray 907 by flappers 902 and 903 via a conveyance path 904.

When outputting a sheet to the stack tray 911 or 912, the following operation is done. A sheet coming into the conveyance path 901 is guided to a conveyance path 905 by the flappers 902 and 903 and delivered to the stack tray 911. The stack trays 911 and 912 are vertically movable. When outputting a sheet to the stack tray 912, the stack tray 912 moves up. When outputting sheets to the stack tray 911 or 912, for example, sheets can also be sorted, offset, or stapled by a stapler 909 via an intermediate tray 908.

When outputting sheets to the booklet tray 921, sheets coming into the conveyance path 901 are guided to a conveyance path 906 via the flappers 902 and 903, and stay at an abutment portion 925. In saddle-stitching, sheets are saddle-stitched by a stapler 923 at the position of an intermediate tray 922. The saddle-stitched sheet bundle is moved to the abutment portion 925. A push member 926 and rollers 927 and 928 are arranged near the abutment portion 925. The push member 926 pushes out toward the sheet bundle at the abutment portion 925. Then, the sheet bundle is pushed out between the rollers 927 and 928, and folded by them. The sheet bundle is delivered to the booklet tray 921 via a conveyance path 929.

<Controller>

The functions of the controller 110 will be described with reference to the block diagram of FIG. 3. A main controller 111 comprises a CPU (processor) 112, a bus controller 113, and a variety of I/F controller circuits (not shown).

The CPU 112 and bus controller 113 control the operation of the whole controller 110. The CPU 112 operates based on a program loaded from a ROM 114 via a ROM I/F 115. This program also describes an operation to interpret PDL (Page Description Language) code data received from a host computer and rasterize it into raster image data. This operation is processed by software. The bus controller 113 controls transfer of data input/output from/to I/Fs, and performs arbitration of bus conflict and control of DMA data transfer.

A DRAM 116 is connected to the main controller 111 via a DRAM I/F 117, and serves as a work area for the operation of the CPU 112 and an area for accumulating image data.

A Codec 118 compresses raster image data accumulated in the DRAM 116 by a format such as MH/MR/MMR/JBIG/JPEG, and decompresses compressed/accumulated code data into raster image data. An SRAM 119 serves as a temporary work area for the Codec 118. The Codec 118 is connected to the main controller 111 via an I/F 120. The bus controller 113 controls DMA transfer between the Codec 118 and the DRAM 116.

A graphic engine 135 performs image rotation, image scaling, color space conversion, and binarization to raster image data accumulated in the DRAM 116. An SRAM 136 serves as a temporary work area for the graphic engine 135. The graphic engine 135 is connected to the main controller 111 via an I/F. The bus controller 113 controls DMA transfer between the graphic engine 135 and the DRAM 116.

A network controller 121 is connected to the main controller 111 via an I/F 123, and to an external network via a connector 122. A general example of the network is Ethernet®.

A general-purpose high-speed bus 125 connects an I/O controller 126 to an expansion connector 124 for connecting an expansion board. A general example of the general-purpose high-speed bus is a PCI bus. According to the embodiment, a control board for controlling the finisher 900 and C/Z-folding unit 800 is connected to the expansion connector 124. That is, the main controller 111 controls the finisher 900 and C/Z-folding unit 800 via the expansion connector 124 and the expansion board (not shown).

The I/O controller 126 comprises asynchronous serial communication controllers 127 of two channels for transmitting/receiving control commands to/from the CPUs of the reading section 200 and printing section 300. An I/O bus 128 connects the asynchronous serial communication controllers 127 to a scanner I/F 140 and printer I/F 145.

A panel I/F 132 is connected to an LCD controller 131. The panel I/F 132 comprises an I/F for display on the liquid crystal display of the operation unit 150 and a key input I/F 130 for inputs from hard keys and touch panel keys.

The operation unit 150 comprises a liquid crystal display, a touch panel adhered onto the liquid crystal display, and a plurality of hard keys. A signal input from the touch panel or hard key is transferred to the CPU 112 via the panel I/F 132. The liquid crystal display displays image data sent from the panel I/F 132. The liquid crystal display displays the functions of the apparatus, image data, and the like.

A real-time clock module 133 updates and saves a date and time managed inside the apparatus, and is backed up by a backup battery 134.

An E-IDE connector 161 connects an external storage device. A hard disk drive 160 is connected to the connector 161, and performs an operation to store image data in a hard disk 162 or read out image data from the hard disk 162.

Connectors 142 and 147 are respectively connected to the reading section 200 and printing section 300. The connector 142 includes an asynchronous serial I/F 143 and video I/F 144. The connector 147 includes an asynchronous serial I/F 148 and video I/F 149.

The scanner I/F 140 is connected to the reading section 200 via the connector 142. The scanner I/F 140 is also connected to the main controller 111 via a scanning unit bus 141. The scanner I/F 140 has a function of processing an image received from the reading section 200. The scanner I/F 140 also has a function of outputting, to the scanning unit bus 141, a control signal generated based on a video control signal sent from the reading section 200. The bus controller 113 controls data transfer from the scanning unit bus 141 to the DRAM 116.

A printer I/F 145 is connected to the printing section 300 via the connector 147. The printer I/F 145 is connected to the main controller 111 via a printer bus 146. The printer I/F 145 has a function of processing image data output from the main controller 111, and outputting the processed image data to the printing section 300. The printer I/F 145 also has a function of outputting, to the printer bus 146, a control signal generated based on a video control signal sent from the printing section 300.

The bus controller 113 controls transfer of raster image data rasterized in the DRAM 116 to the printer. The raster image data is DMA-transferred to the printing section 300 via the printer bus 146 and video I/F 149.

<Operation Unit>

Figure 4:
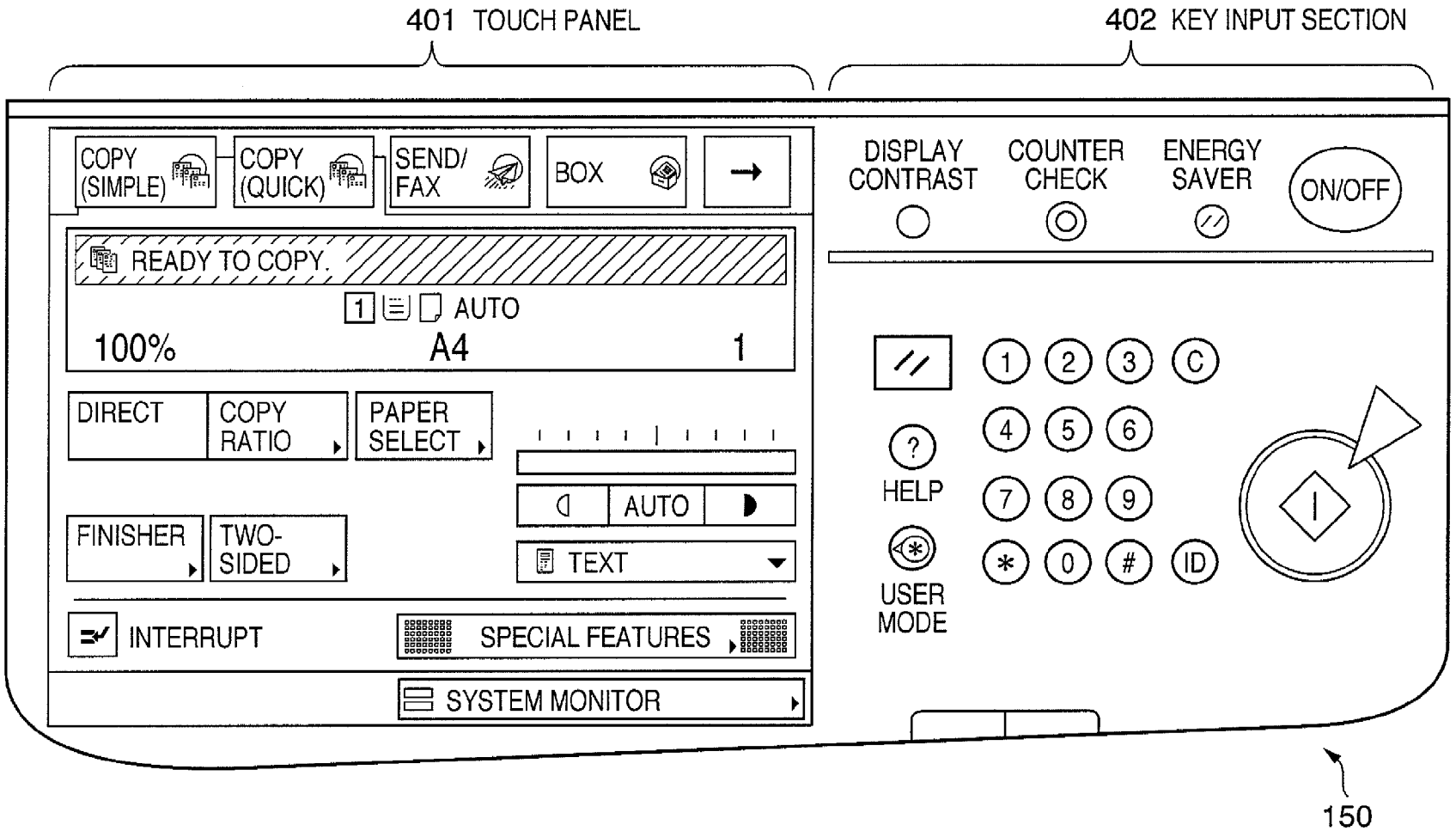
FIG. 4 is a view for explaining an example of an operation unit 150.

FIG. 4 is a view showing the outer appearance of the operation unit 150. The operation unit 150 comprises a key input section 402 and touch panel 401. The key input section 402 can accept a user operation with hard keys. The touch panel 401 serves as an example of a display unit capable of accepting a user operation with soft keys (display keys).

Figure 5:
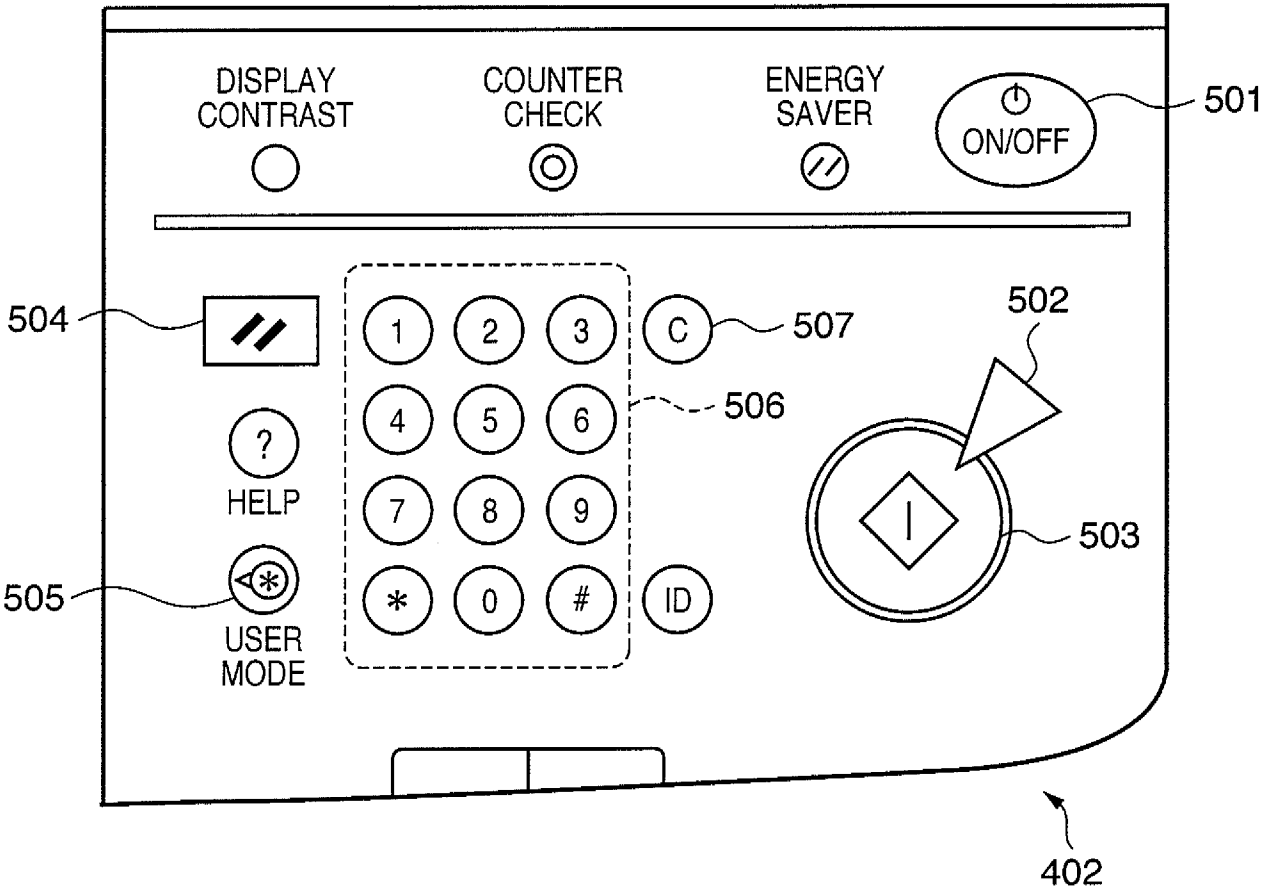
FIG. 5 is a view for explaining a key input section 402.

FIG. 5 is a view showing the arrangement of the key input section 402 in detail. The key input section 402 includes a power switch 501. In response to a user operation to the power switch 501, the controller 110 controls to switch between the standby mode (normal operation state) and the sleep mode (state in which the program stops in wait for an interrupt in preparation for network printing, facsimile transmission, or the like, suppressing power consumption). The controller 110 controls to accept an operation to the power switch 501 while a main power switch (not shown) for supplying power to the whole system is ON.

A start button 503 is used to accept an instruction from the user to start a kind of job processing designated by the user, such as copying or transmission of a target job. A stop key 502 is used to accept an instruction from the user to interrupt the processing of an accepted job. A ten-key pad 506 is used to accept input of numerical values from the user during various settings. A clear key 507 is used to accept an instruction from the user to clear various parameters input by him via the ten-key pad 506 or the like. A reset key 504 is used to accept an instruction from the user to invalidate various settings temporarily made for a target job and restore the setting values to default values. A user mode key 505 is used to accept an instruction to shift a window displayed on the touch panel 401 to a system setup window for each user.

Figure 6:
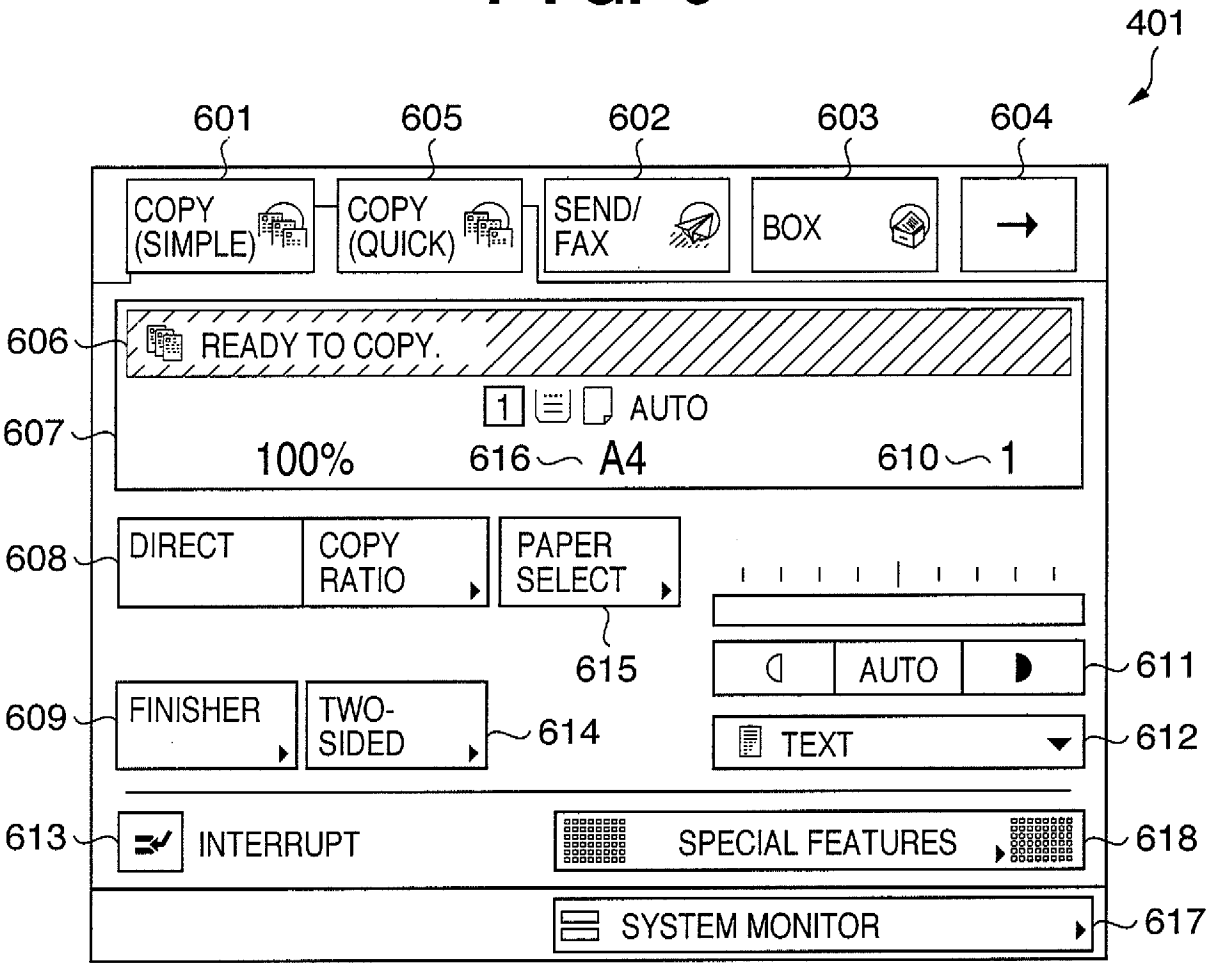
FIG. 6 is a view for explaining a display control example on a touch panel 401.

The arrangement of a window displayed on the touch panel 401 will be explained in more detail with reference to FIGS. 6 and 7. FIG. 6 shows a window displayed on the touch panel 401 under the control of the controller 110 when the user selects (touches) a copy tab 601. When the user selects a send tab 602, the controller 110 causes the touch panel 401 to display the operation window of the data send function (e.g., FAX transmission or E-mail sending). When the user selects a box tab 603, the controller 110 causes the touch panel 401 to display the operation window of the box function.

The box function uses a plurality of data storage boxes (to be referred to boxes hereinafter) which are virtually ensured in the hard disk 162. The plurality of boxes can be used separately by respective users. For example, the controller 110 frees a memory area of the hard disk 162 that corresponds to a box selected from a plurality of boxes by the user by operating the touch panel 401. The controller 110 stores acquired image data in the free memory area. For example, in response to an instruction input from the user via the operation unit 150, the controller 110 controls to store, in a box selected by the user, document data of a job accepted from the scanning unit 210. For example, text data of a job accepted from an external apparatus (e.g., the PC 191 or 192) via the network controller 121 can also be stored in a box designated by the user in accordance with a user instruction input via the user interface of the external apparatus.

When the user inputs an instruction from the operation unit 150 to output job data stored in a box, the controller 110 reads out the designated data from a memory area of the hard disk 162 that corresponds to the designated box. Then, the controller 110 controls respective units of the apparatus to output the data in a form designated by the user. For example, the controller 110 controls the printing section 300 to print out designated data, or controls the network controller 121 to transmit the data to an external apparatus.

When the user selects an option tab 604 on the touch panel 401 in FIG. 6, the controller 110 causes the touch panel 401 to display a window for setting optional functions such as scanning setting. When the user selects a system monitor key 617, the controller 110 causes the touch panel 401 to display a display window for notifying the user of the MFP state or status.

When the user selects a two-sided printing key 614, the controller 110 causes the touch panel 401 to display a window which allows the user to set which of single-sided printing and two-sided printing is executed to print a target job. In response to press of a print paper selection key 615 by the user, the controller 110 causes the touch panel 401 to display a window which allows the user to set a feeding unit, sheet size, and sheet type (medium type) necessary to print a target job. In response to selection of a key 612, the controller 110 causes the touch panel 401 to display a window which allows the user to select an image processing mode (e.g., text mode or photo mode) suited to a document image. When the user operates a density setting key 611, the controller 110 allows him to adjust the density of the output image of a print job.

The controller 110 causes the touch panel 401 to display, in a status display field 606, the operation state (e.g., standby, warm-up, printing, jam, or error) of an event which occurs. The controller 110 causes the touch panel 401 to display information in a display field 607 for prompting the user to confirm the copy ratio of a target job. The controller 110 causes the touch panel 401 to display information in a display field 616 for prompting the user to confirm the sheet size and feeding mode of a target job. The controller 110 causes the touch panel 401 to display, in a display field 610, information for prompting the user to confirm the number of copies of a target job, and information for prompting the user to confirm the sheet number during printing. In this manner, the controller 110 causes the touch panel 401 to display various kinds of information to be announced to the user.

When the user selects an interrupt key 613, the controller 110 stops a job during printing, and allows executing printing of a job designated by the user. When the user selects a "special features" key 618, the controller 110 causes the touch panel 401 to display a window for special print settings such as various image processes and layouts including two-page separation, cover/sheet insertion, image combination, image movement, and bookbinding.

Figure 7:
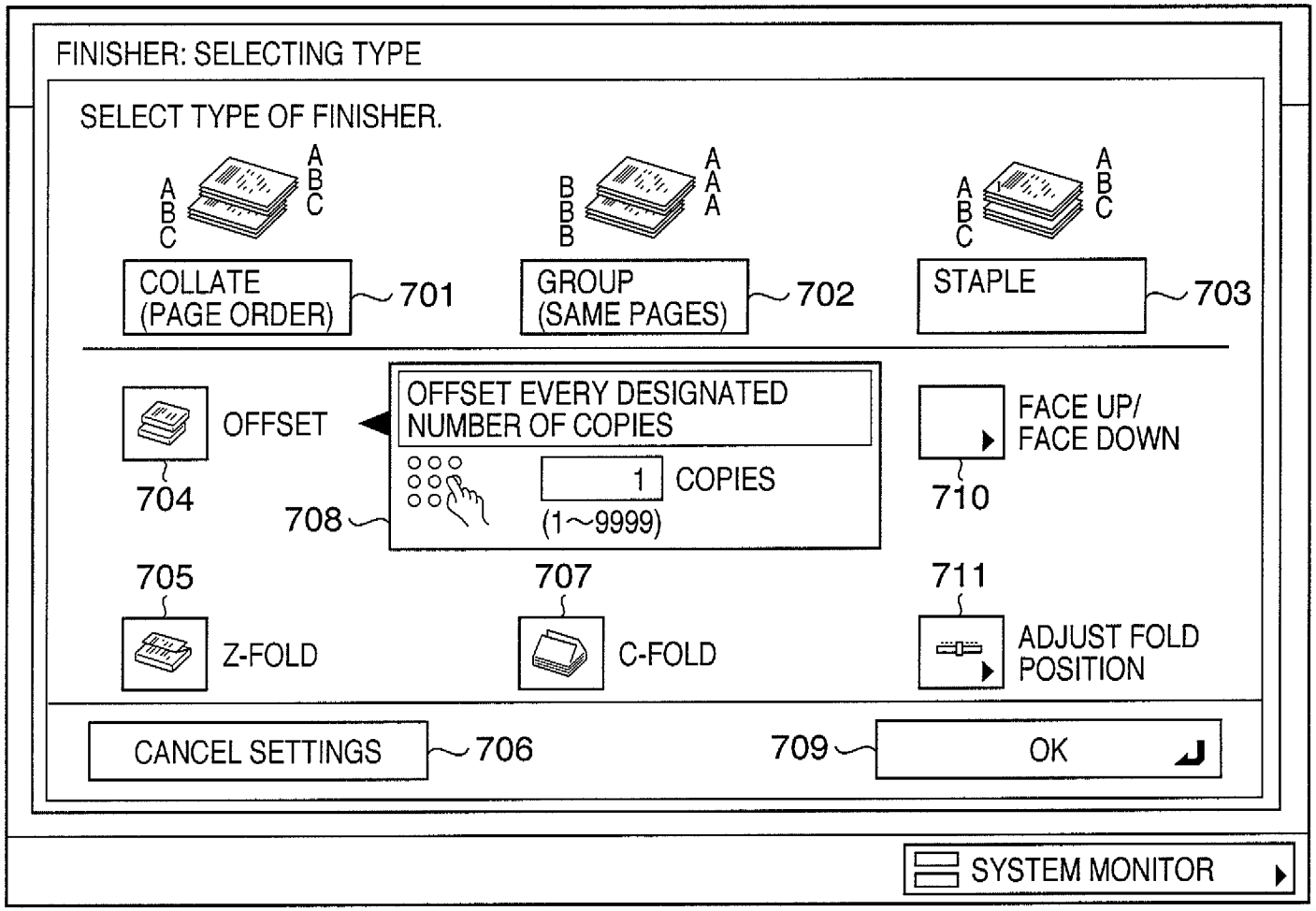
FIG. 7 is a view for explaining a display control example on the touch panel 401.

FIG. 7 shows a window displayed on the touch panel 401 when the user selects a finishing key 609 in the window of FIG. 6. This window allows the user to set sheet processing such as stapling, folding, and offset. Keys 701 to 705 and 707 are used to designate different finishing methods, and a selected key changes in color. If the user selects an OK key 709 while the color of the selected key changes, the controller 110 stores a setting corresponding to the key selected upon selecting the OK key, and uses the setting in printing.

The collate (sort) key 701 is used to collate sheets of each copy in the page order. The group key 702 is used to group sheets of each page. The staple key 703 is used to set stapling. The keys 701 to 703 can be set not simultaneously but only exclusively. The Z-folding key 705 to set Z-folding, and the C-folding key 707 to set C-folding are also exclusive. For an impossible combination, like a combination of stapling and C-folding, when the staple key 703 is selected, the C-folding key 707 is grayed out and cannot be selected. When the C-folding key 707 is selected first, the staple key 703 cannot be selected. In this way, when settings cannot be combined, either corresponding key cannot be selected.

The offset key 704 is used to make a setting of offsetting the output position every designated number of copies. The controller 110 controls the finisher 900 to offset the output position every number of copies that is input to a copy count input field 708.

When the user selects a face-up/face-down designation key 710, the controller 110 causes the touch panel 401 to display a window which allows the user to designate face-up delivery or face-down delivery. When the user selects a fold position adjustment key 711, the controller 110 causes the touch panel 401 to display a window which allows the user to adjust the parameter of the fold position in Z-folding or C-folding. If the user selects a setting cancel button 706, the window in FIG. 7 returns to one in FIG. 6 without reflecting contents set in the window of FIG. 7. If the user selects the OK key 709, the window in FIG. 7 returns to one in FIG. 6 after reflecting contents set in the window of FIG. 7.

Figure 3:
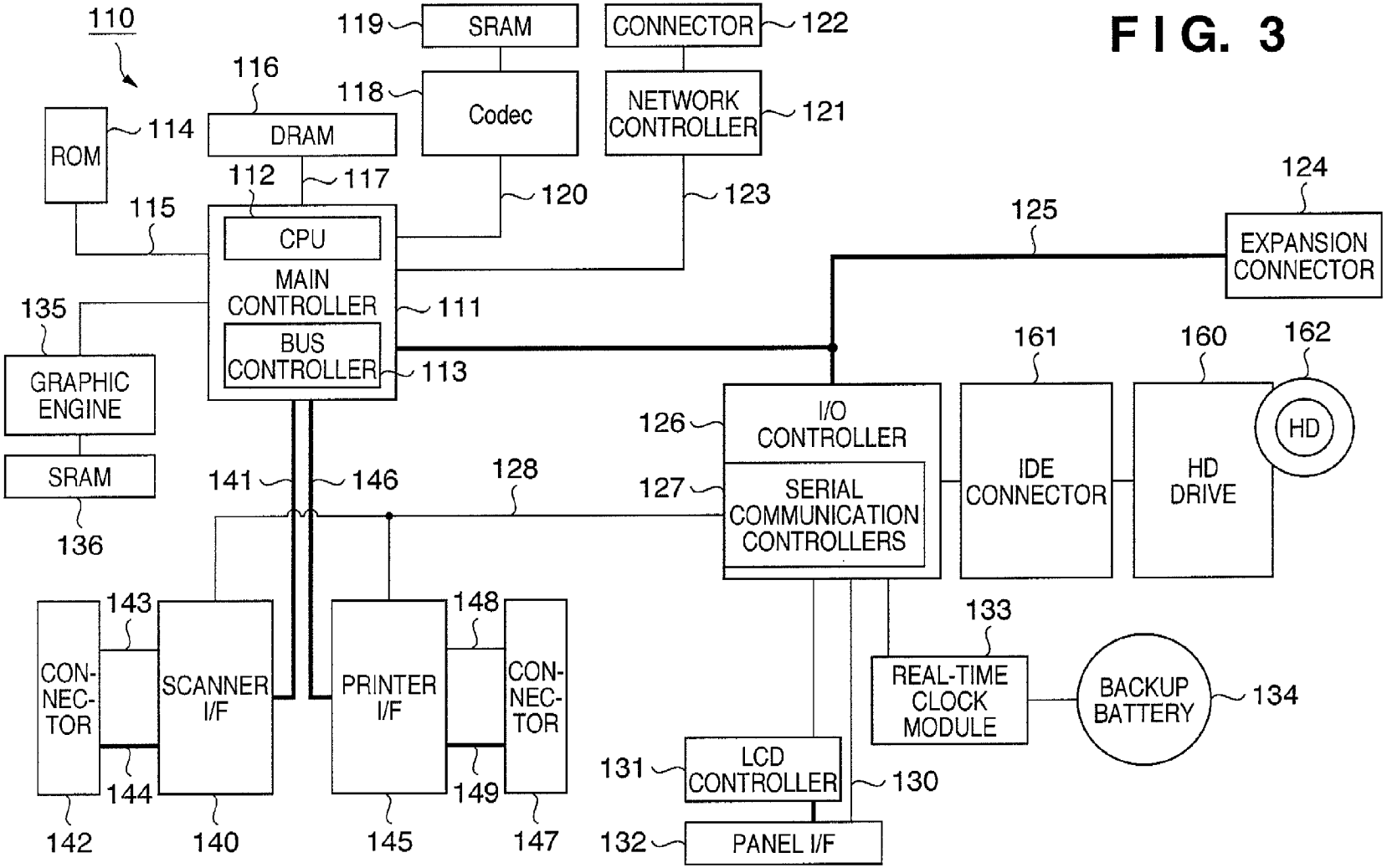
FIG. 3 is a block diagram showing the configuration of a controller 110.

Various settings made by these key operations are stored as print settings in the DRAM 116 in FIG. 3. At the start of printing by pressing the start button 503, these settings are read out from the DRAM 116 and used for control.

Figure 14:
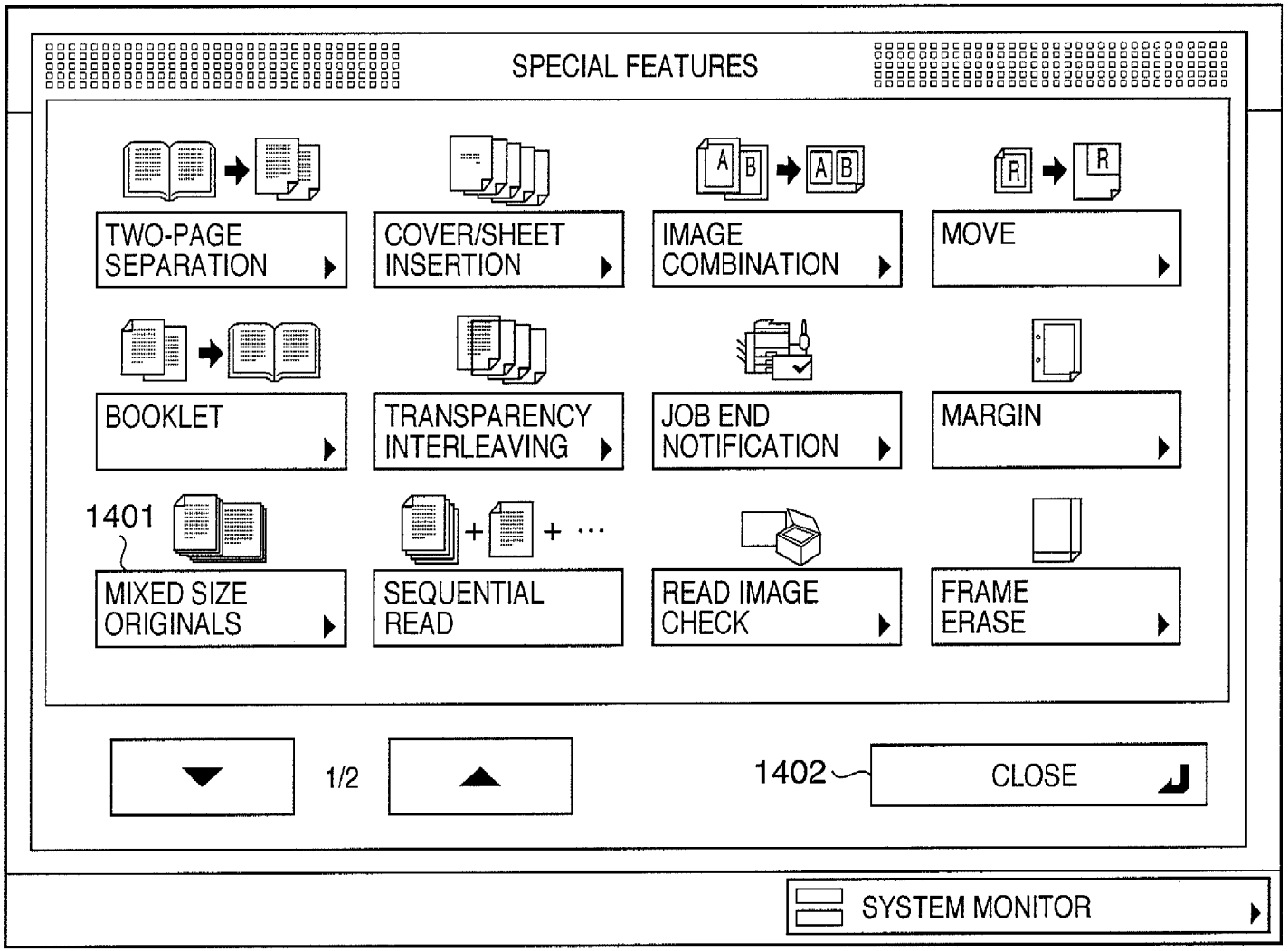
FIG. 14 is a view showing a window displayed on the touch panel 401.

FIG. 14 is a view showing a window displayed on the touch panel 401 when the user presses the "special features" key 618 in FIG. 6. This window allows the user to set various image processes and layouts including two-page separation, cover/sheet insertion, image combination, image movement, and bookbinding.

Figure 15:
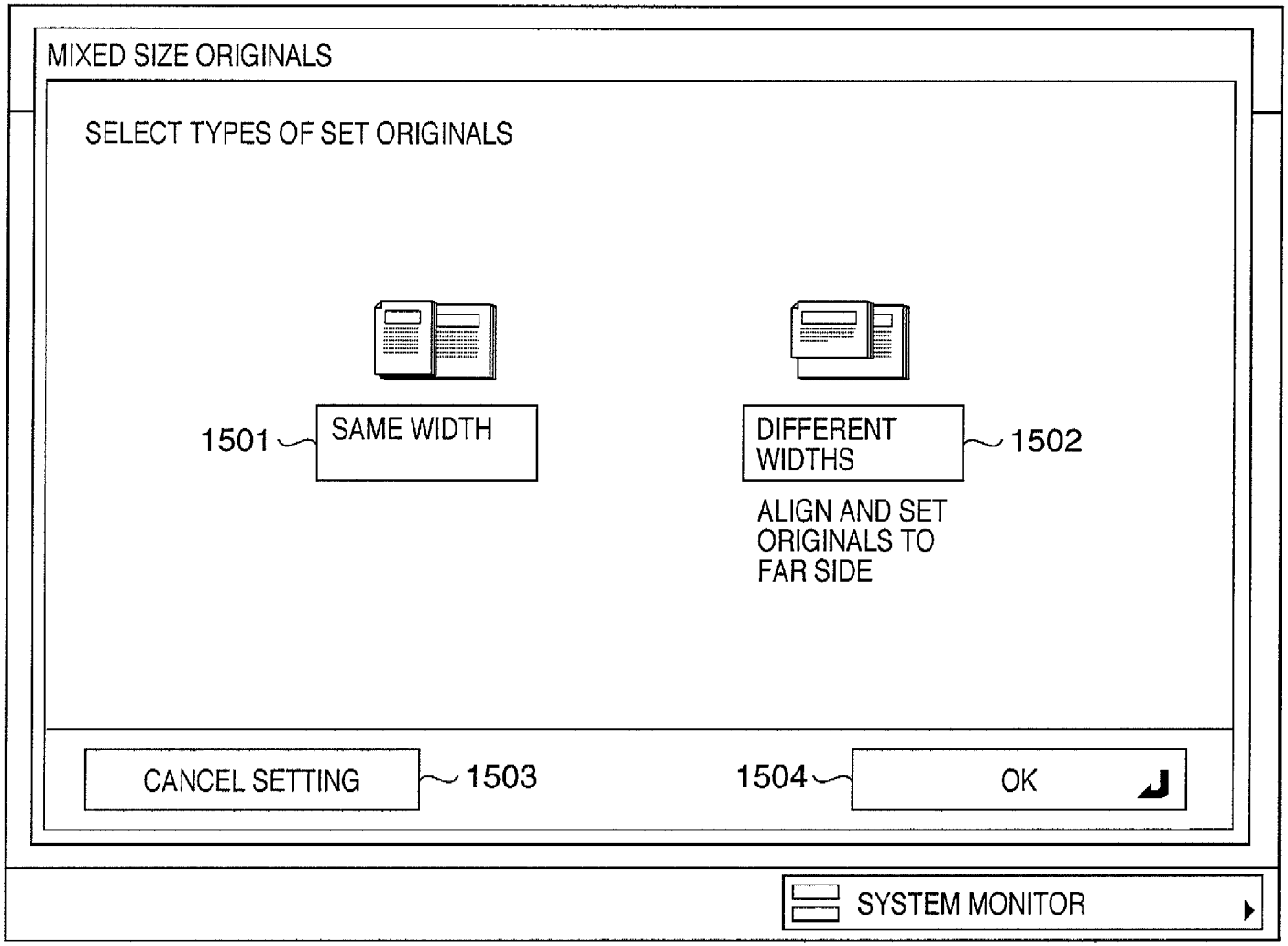
FIG. 15 is a view for explaining a display control example on the touch panel 401.

When the user selects a "mixed size originals" key 1401, the controller 110 causes the touch panel 401 to display a window shown in FIG. 15 for an advanced setting for mixed size originals. In FIG. 15, the user can set whether the widths of set original sheets are equal or different. When the user selects a "same width" key 1501, the controller 110 determines that a plurality of original sheets set on the document feeding unit 250 have the same width. When the user selects a "different width" key 1502, the controller 110 determines that a plurality of set original sheets have different widths. After the start of reading, original sheets are scanned based on the determination of the key. When the user selects a setting cancel key 1503, the setting of mixed size originals is canceled, and the window in FIG. 15 returns to one in FIG. 14. When the user selects an OK key 1504, the advanced setting of mixed size originals is determined.

By displaying these windows and accepting setting inputs, the controller 110 functions as a unit for accepting sheet folding instructions to a plurality of sheets including a sheet of the first size and that of the second size smaller than the first size.

<Z-Folding Processing>

Figure 16:
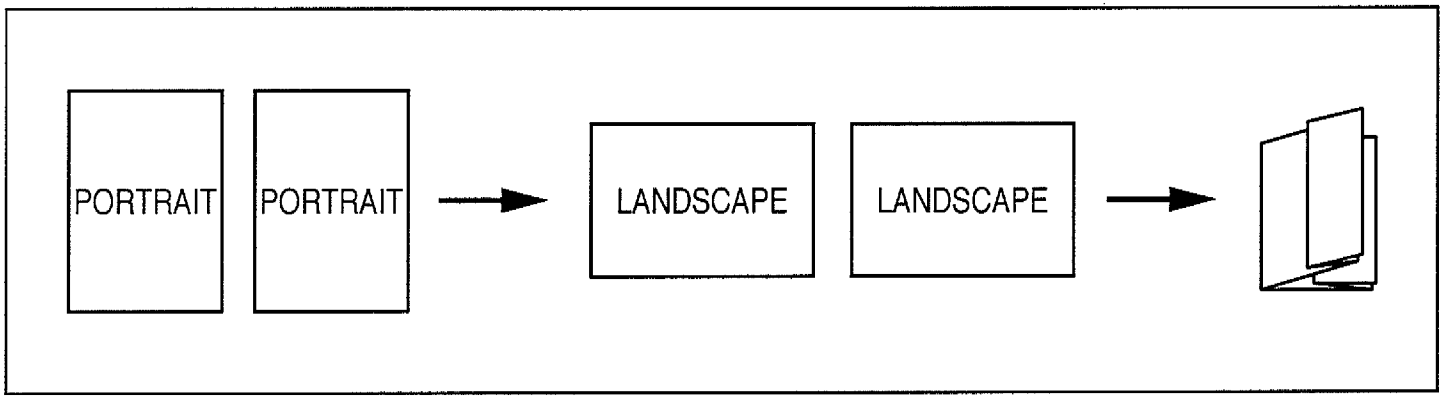
FIG. 16 is a view for explaining Z-folding to a portrait print sheet.

Image conversion processing when Z-folding is designated will be explained with reference to FIGS. 16 and 17. FIG. 16 is a view showing processing when performing Z-folding to image data in the portrait orientation. When read image data or image data sent from a host computer connected to a network is in the portrait orientation (long side coincides with the main scanning direction), the controller 110 rotates the image data through 90° using the graphic engine 135, as shown in FIG. 16. As a result, the orientation of the image data changes to the landscape orientation. The controller 110 controls the print unit 310 to print the image data on a print sheet in the landscape orientation. The controller 110 controls the C/Z-folding unit 820 to Z-fold the printed sheet.

Figure 17:
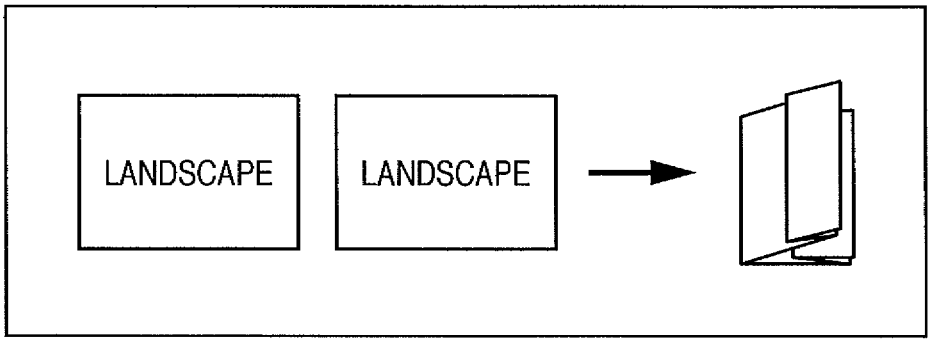
FIG. 17 is a view for explaining Z-folding to a landscape print sheet.

When read document image data or image data sent from the host computer connected to the network is in the landscape orientation, the controller 110 controls the print unit 310 to directly print the image data on a print sheet in the landscape orientation, as shown in FIG. 17. The controller 110 controls the C/Z-folding unit 820 to Z-fold the printed sheet.

<Case where Print Sheets in Portrait Orientation and Landscape Orientation Coexist>

A Z-folding operation when outputting image data of different sizes at once will be described with reference to FIGS. 18 and 19. A case where A4 portrait image data (document) and A3 landscape image data are simultaneously output will be exemplified. The method of designating Z-folding has been described with reference to FIGS. 6 and 7. The method of designating mixed size originals has been described with reference to FIGS. 14 and 15.

Figure 18:
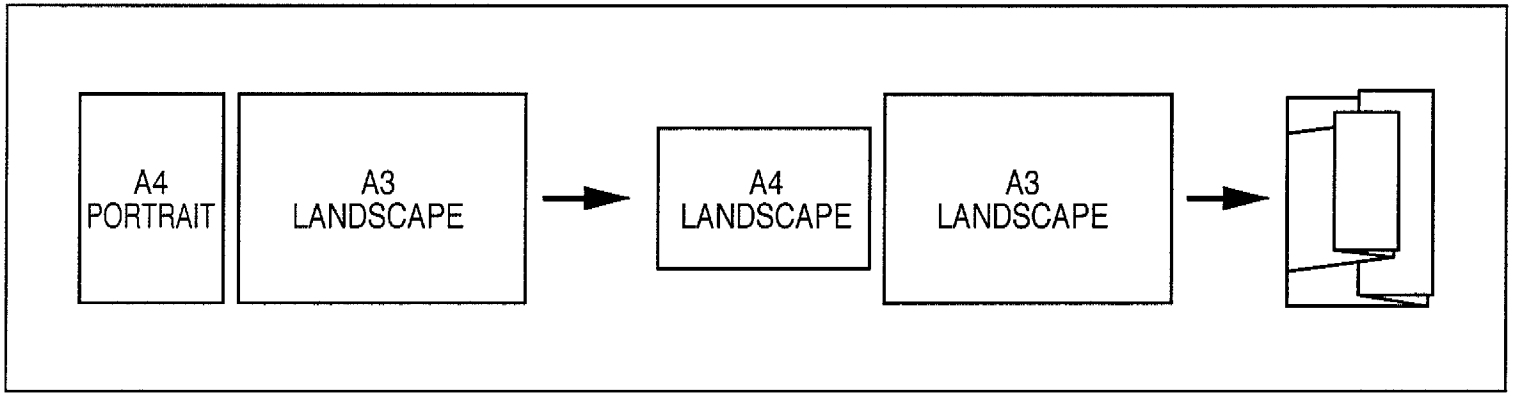
FIG. 18 is a view for explaining Z-folding when A4 portrait and A3 landscape print sheets coexist.
Figure 19:
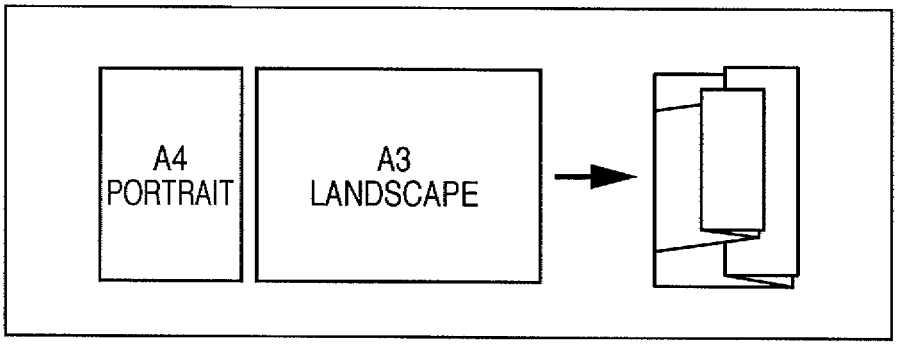
FIG. 19 is a view for explaining Z-folding when A4 portrait and A3 landscape print sheets coexist.

Even when document sheets of different sizes coexist, as shown in FIG. 18, the controller 110 rotates A4 portrait image data through 90° into A4 landscape image data by using the graphic engine 135. Then, the controller 110 controls to print the image on an A4 landscape print sheet. The A4 landscape print sheet undergoes C/Z-folding processing. As a result, the print sheet of the A5 size which is half the A4 size is discharged.

As for A3 landscape image data, the controller 110 controls the C/Z-folding unit 820 to Z-fold a print sheet and discharge it. The size of the Z-folded print sheet becomes the A4 size which is half the A3 size.

As described above, when A4 portrait and A3 landscape image data coexist and their print sheets are Z-folded, the sizes of their output results become different.

In some cases, it is desirable not to perform Z-folding processing to an A4 image when, for example, an A3 landscape image is inserted into A4 portrait images of a plurality of pages and all print sheets are to be bound into the A4 portrait size. More specifically, as shown in FIG. 19, A4 portrait image data is printed out without rotating it or performing Z-folding processing. Only when printing A3 landscape image data, Z-folding processing is done. Then, all output results have the A4 size and are suitable for bookbinding and filing. Hence, when A4- and A3-size document sheets coexist, it is desirably controlled to perform Z-folding for only a document sheet of a larger size.

Figure 20:
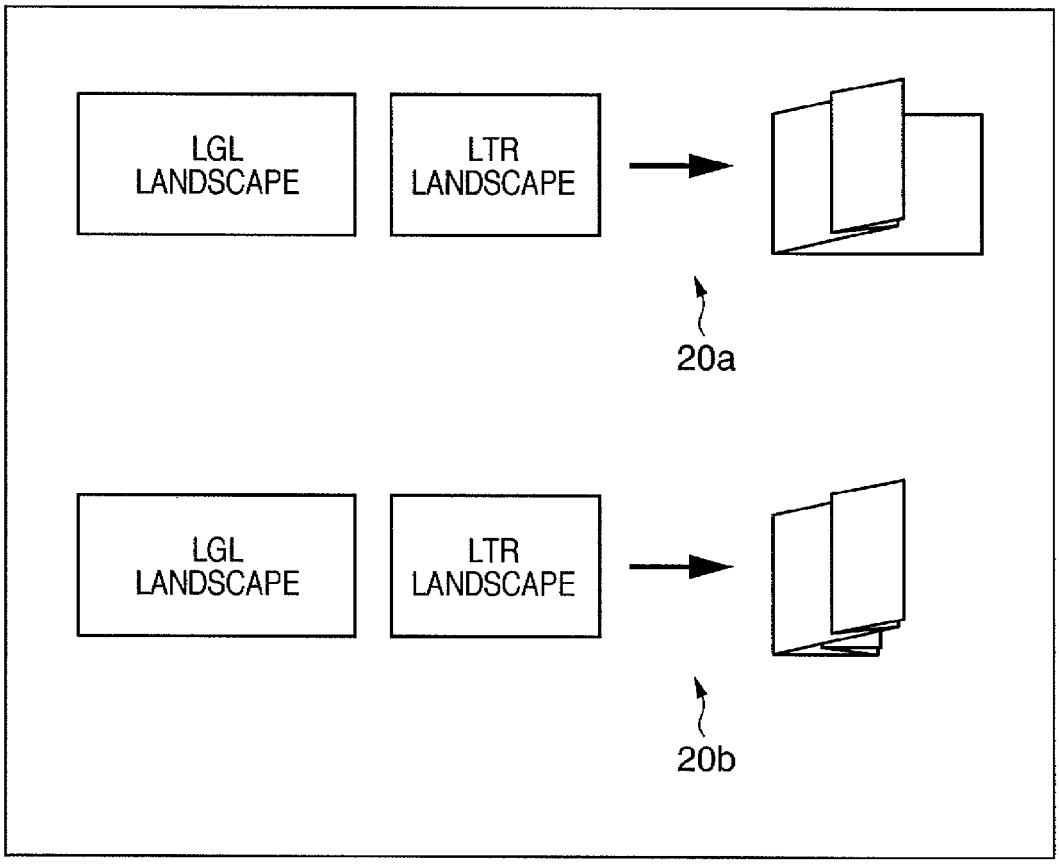
FIG. 20 is a view for explaining Z-folding when LGL landscape and LTR landscape print sheets coexist.

This is not limited to a job including both A4- and A3-size image data, and also applies to a case of, for example, executing a job including both LGL landscape image data and LTR landscape image data, as shown in FIG. 20. More specifically, the user may want to output print sheets as shown as 20*a* in FIG. 20, instead of Z-folding all print sheets and outputting them as shown as 20*b* in FIG. 20. That is, the user may want to perform Z-folding processing to only LGL landscape image data and obtain output results by inserting the Z-folded LGL landscape print sheet into LTR landscape print sheets.

<Z-Folding Control>

Figure 21:
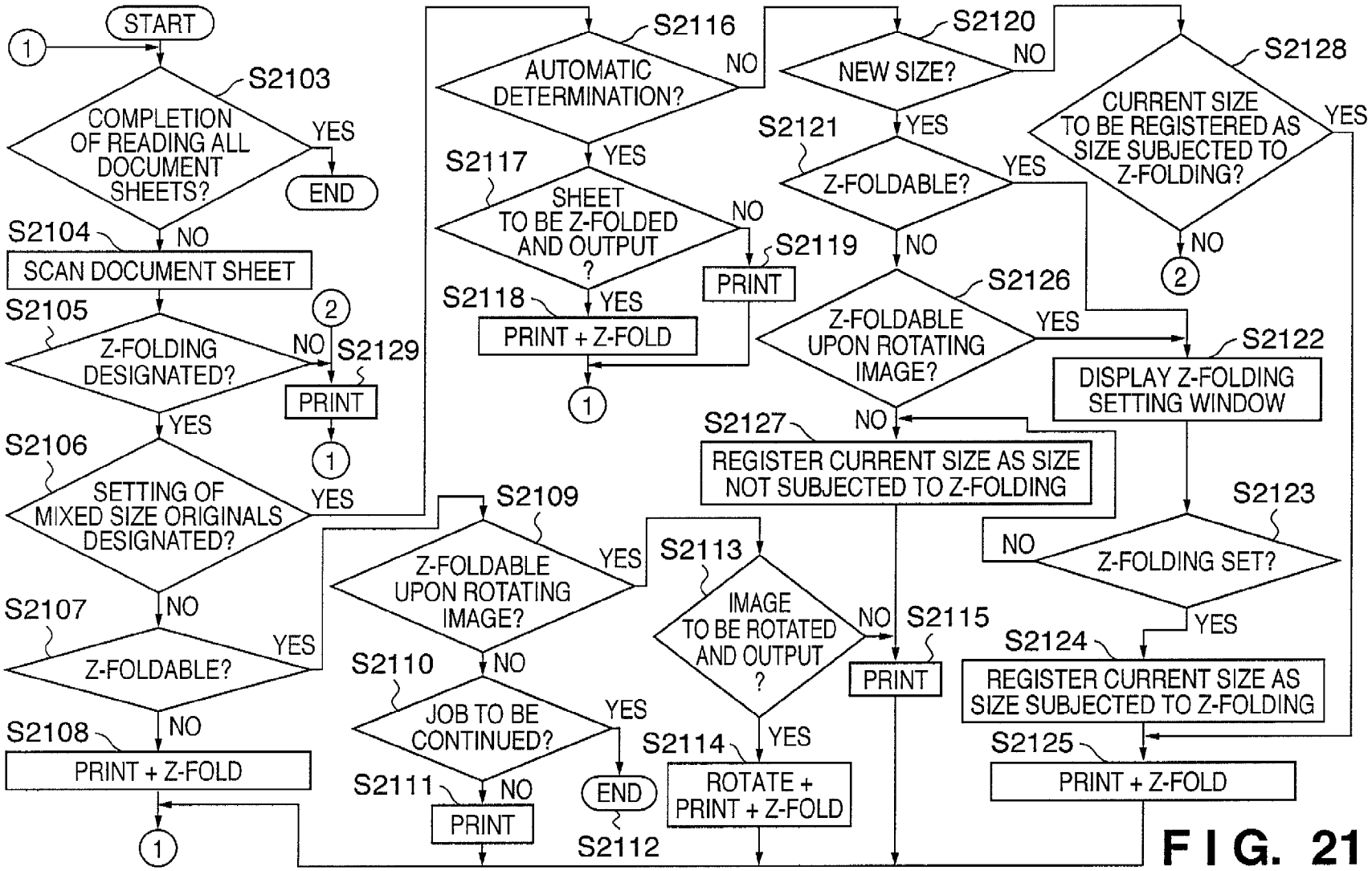
FIG. 21 is a flowchart for explaining a Z-folding control method.

According to the embodiment, the image input/output system 100 operates to perform Z-folding processing considering a user request as described above. More specifically, the ROM 114 stores a program for controlling Z-folding in accordance with a sequence as shown in FIG. 21. The CPU 112 of the main controller 111 reads out and executes the program. In response to this, the controller 110 controls respective units of the image input/output system 100.

When the controller 110 detects press of the start button 503, it starts the process shown in FIG. 21. In step S2103, the controller 110 detects an output from a document sensor incorporated in the document feeding unit 250, and determines whether a document sheet remains on the document feeding unit 250. The controller 110 can determine whether all document sheets set on the document feeding unit 250 have been read. If no document sheet remains, the controller 110 determines that all document sheets have been read, and ends the copy operation. If a document sheet still remains on the document feeding unit 250, the process proceeds to step S2104 to feed the document sheet and read its image.

In step S2105, the controller 110 determines whether Z-folding is designated as a print setting. If no Z-folding is designated, the process proceeds to step S2129 to print the read image data on a print sheet and deliver the print sheet without Z-folding it. If Z-folding is designated, the process proceeds from step S2105 to step S2106, and the controller 110 determines whether the setting of mixed size originals is designated as a print setting. By determining whether the setting of mixed size originals is designated, the controller 110 determines, for a sheet folding instruction, whether sheets include a sheet of the first size and that of the second size smaller than the first size.

If the controller 110 determines in step S2106 that the setting of mixed size originals is not designated as a print setting, the process proceeds to step S2107, and the controller 110 determines whether a print sheet on which a read image is directly printed has a Z-foldable size. If a print sheet on which a read image is directly printed has a Z-foldable size, the process proceeds to step S2108, and the controller 110 controls the print unit 310 to print image data on the print sheet, and controls the C/Z-folding unit 820 to Z-fold the print sheet and deliver it. For example, when copying only A3 landscape images or copying only A4 landscape document sheets, an output result as shown in FIG. 17 can be obtained in step S2108. The process returns from step S2108 to S2103 to repeat the series of processes.

Figure 22:
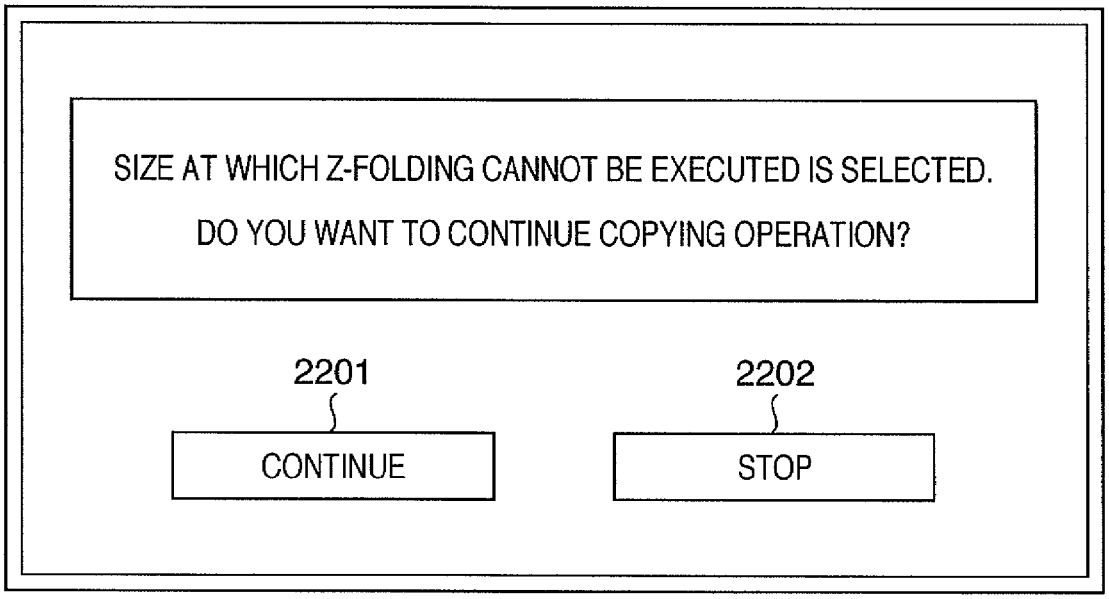
FIG. 22 is a view for explaining a display control example on the touch panel 401 of the operation unit 150 in FIG. 4.

If the controller 110 determines in step S2107 that a print sheet on which a read image is directly printed does not have a Z-foldable size, the process proceeds to step S2109, and the controller 110 determines whether the print sheet can be Z-folded upon rotating the image. If the controller 110 determines in step S2109 that the print sheet cannot be Z-folded even upon changing the image orientation, the process proceeds from step S2109 to step S2110. The controller 110 displays a window as shown in FIG. 22 on the touch panel 401, and prompts the user to select whether to continue the copy job in progress. If the user selects a continuation key 2201 in FIG. 22, the process proceeds to step S2111 to print image data on a print sheet and deliver the print sheet without Z-folding it. Then, the process returns from step S2111 to S2103 to process the next document sheet. If the user selects a stop key 2202 in FIG. 22, the process proceeds to step S2112 to end the copy job.

Figure 23:
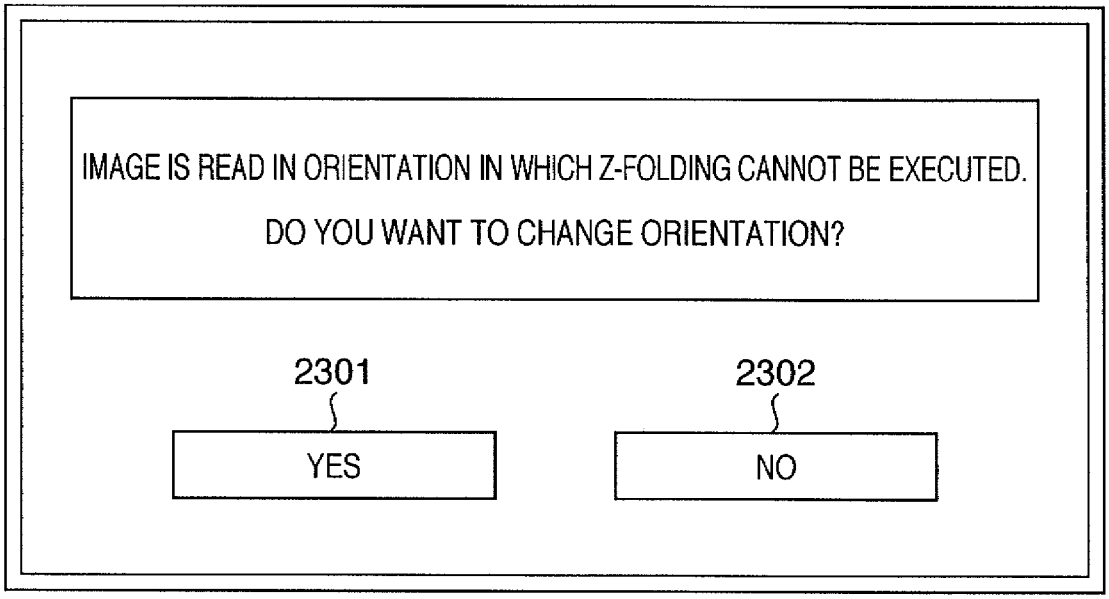
FIG. 23 is a view for explaining a display control example on the touch panel 401 of the operation unit 150 in FIG. 4.

If the controller 110 determines in step S2109 that the print sheet can be Z-folded upon rotating image data, the process proceeds to step S2113. The controller 110 displays a window as shown in FIG. 23 on the touch panel 401, and prompts the user to select whether to rotate image data and Z-fold a print sheet. If the user selects a "YES" key 2301, the controller 110 determines that the user has input an instruction to rotate image data and Z-fold a print sheet. The process proceeds to step S2114 to rotate image data, print it on a print sheet in the landscape orientation, Z-fold the print sheet, and deliver it. Then, the process returns to step S2103 to repeat the series of processes.

For example, when copying only A4 portrait document sheets, an output result as shown in FIG. 16 can be obtained. If the user selects a "NO" key 2302 in FIG. 23, the controller 110 determines that the user has input an instruction not to Z-fold a print sheet. The process proceeds to step S2115 to print a print sheet without changing the orientation, and deliver the print sheet without Z-folding it. It is also possible to make the determination in step S2113 for only the first page and process all subsequent pages in accordance with the setting of the first page, or make the determination for each page.

Figure 24:
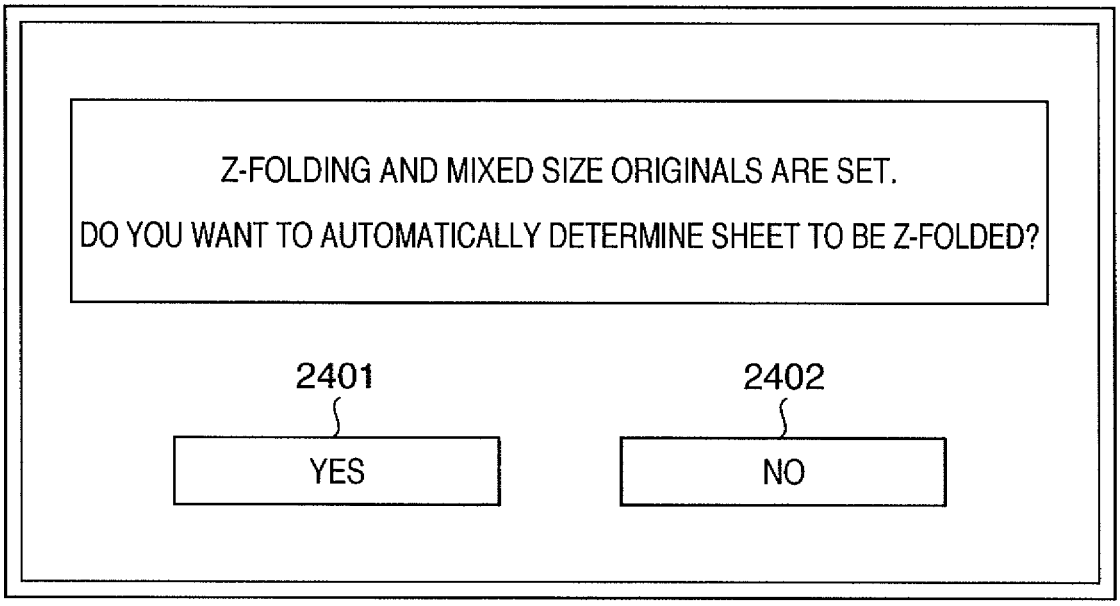
FIG. 24 is a view for explaining a display control example on the touch panel 401 of the operation unit 150 in FIG. 4.

Processing when the controller 110 determines in step S2106 that the setting of mixed size originals is designated as a print setting will be explained. If the setting of mixed size originals is designated, the process proceeds to step S2116, and the controller 110 displays a window as shown in FIG. 24 on the touch panel 401. The controller 110 prompts the user to select whether to automatically determine a size for performing Z-folding and execute the operation. This window display suffices to be set only once at the beginning, and need not be presented for the second and subsequent document sheets. The window display may also be selected as a print setting by the user. If the controller 110 determines that the user has selected a "YES" key 2401, the process shifts to an automatic determination mode serving as the first mode. In step S2117, the controller 110 determines whether the size of a print sheet on which image data is printed is subjected to Z-folding. More specifically, depending on whether the print sheet has an unrotatable size, the controller 110 determines whether to Z-fold the print sheet. The unrotatable print sheet size means a large-size print sheet such as an A3- or LGL (legal)-size print sheet. If the print sheet has an unrotatable size, the process proceeds to step S2118 to print the print sheet, Z-fold it, and deliver it. If the print sheet has a rotatable size, the process proceeds to step S2119 to print the print sheet and deliver it without Z-folding it. The rotatable print sheet size means a small-size print sheet such as an A4- or LTR (letter)-size print sheet.

In this case, sizes subjected to Z-folding are determined from the beginning, but the present invention is not limited to this. For example, when the user designates the setting of mixed size originals, he may also be prompted to set a size subjected to Z-folding and a size not subjected to Z-folding before the start of copying, and the setting contents may also be referred to. When the user designates Z-folding, the controller 110 may also prompt him to set a Z-folding size. Once the user sets a Z-folding size, the same setting contents may also always be referred to in Z-folding unless he voluntarily changes the setting contents. Alternatively, the Z-folding priority order may also be set for a plurality of types of print sheets. In this case, when a plurality of types of document sheets are set, their types are detected. Only print sheets having high priorities are Z-folded and output. Print sheets having low priorities are output without Z-folding them.

It is also possible to, after the start of copying, scan all document sheets, determine their sizes, and Z-fold only large-size print sheets. This determination suffices to be made in step S2106. In this case, the user need not designate whether mixed size originals exist.

To process a job sent from a host computer, a print sheet to be Z-folded in printing can also be determined by analyzing the contents of the job. For example, it may also be controlled to Z-fold all print sheets except the smallest print sheet, or Z-fold only the largest print sheet.

Figure 25:
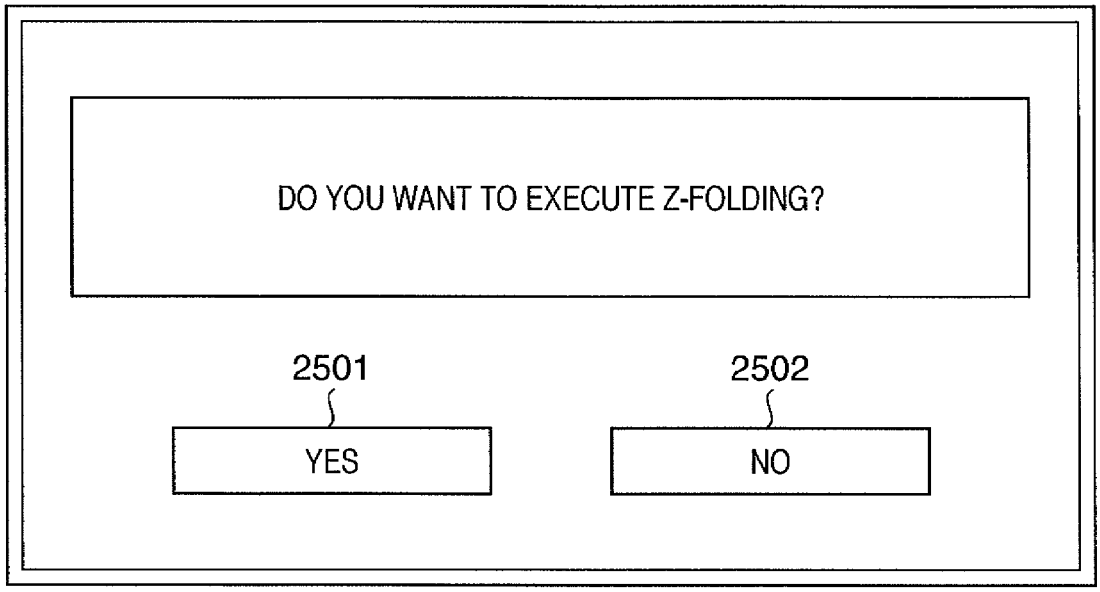
FIG. 25 is a view for explaining a display control example on the touch panel 401 of the operation unit 150 in FIG. 4.

If the controller 110 determines in step S2116 that the user has selected a "NO" key 2402, the process shifts to a manual determination mode serving as the second mode. Then, the process proceeds to step S2120. In step S2120, the controller 110 determines whether a print sheet size is processed for the first time during copying in progress. If the print sheet size is new, the process proceeds to step S2121, and the controller 110 further determines whether the print sheet size is Z-foldable. If the print sheet size is not Z-foldable, the process proceeds to step S2126 to determine whether the print sheet can be Z-folded upon rotating and printing an image. If the print sheet can be Z-folded upon rotating and printing an image, the process proceeds to step S2122. If the controller 110 determines in step S2121 that the print sheet can be Z-folded, the process proceeds to step S2122. In step S2122, the controller 110 displays a window as shown in FIG. 25 on the touch panel 401, and prompts the user to select whether to Z-fold the print sheet. Then, the process proceeds to step S2123. In step S2123, the controller 110 determines whether the user has selected a "YES" key 2501 in FIG. 25. If the controller 110 determines that the user has selected the "YES" key 2501 in FIG. 25, the process proceeds to step S2124 to temporarily register the current size as a Z-folding size in the DRAM 116. The process proceeds to step S2125, and if the image needs to be rotated, it is rotated and printed on a print sheet. The print sheet is Z-folded and delivered.

If the controller 110 determines in step S2123 that the user has selected a "NO" key 2502 in FIG. 25, or determines in step S2126 that the print sheet cannot be Z-folded even upon rotating an image, the process proceeds to step S2127. In step S2127, the controller 110 temporarily registers the determined print sheet size as a size not subjected to Z-folding. The process proceeds to step S2115 to print a print sheet and deliver it without Z-folding it. If the controller 110 determines in step S2120 that the print sheet size is not new, the process proceeds to step S2128 to read out contents registered in the DRAM 116 and determine whether the print sheet size is registered as a Z-folding size. If the print sheet size is registered as a Z-folding size, the process proceeds to step S2125 to print a print sheet, Z-fold it, and output it. If necessary, the image is also rotated. If the controller 110 determines in step S2128 that the determined print sheet size is not registered as a Z-folding size, the process proceeds to step S2129 to print a print sheet and output it without Z-folding it. In this way, if the determination mode is not the automatic determination mode, a sheet of a size subjected to folding and a sheet of a size not subjected to folding are set on the basis of a user input.

<Concrete Example>

For example, when the user designates copying of an A4 portrait document sheet and A3 landscape document sheet, the controller 110 displays the window in FIG. 24. When the user sets Z-folding and the automatic determination mode, the controller 110 outputs an A4 portrait print sheet in step S2119 without Z-folding it, and Z-folds and outputs an A3 landscape print sheet in step S2118. The user can obtain an output result shown in FIG. 19. For example, when the user designates copying of an LGL landscape document sheet and LTR landscape document sheet, the controller 110 displays the window in FIG. 24. When the user sets Z-folding and the automatic determination mode, the controller 110 outputs an LTR landscape print sheet in step S2119 without Z-folding it, and Z-folds and outputs an LGL landscape print sheet in step S2118. The user can obtain an output result shown as 20*a* in FIG. 20.

Even when A4 portrait and A3 landscape document sheets coexist, the process proceeds to step S2124 to obtain an output result shown in FIG. 18 for these document sheets. Similarly, even when LGL landscape and LTR landscape document sheets coexist, the process proceeds to step S2124 to obtain an output result shown as 20*b* in FIG. 20 for these document sheets.

When the user designates copying of LGL landscape and LTR landscape document sheets, and sets neither Z-folding nor the automatic determination mode in FIG. 24, the controller 110 displays the window in FIG. 25 in step S2122 for an LTR landscape print sheet. Since the user does not set Z-folding, the process proceeds from step S2123 to steps S2127 and S2125 to output a print sheet without Z-folding it.

Also for an LGL landscape print sheet, the controller 110 displays the window in FIG. 25. If the user selects the "YES" key 2501 in this window, the process proceeds from step S2123 to steps S2124 and S2125 to Z-fold and output a print sheet. Accordingly, an output result shown as 20*a* in FIG. 20 can be obtained.

In this fashion, the controller 110 controls the C/Z-folding unit to fold a sheet of the first size and not to fold a sheet of the second size smaller than the first size in accordance with a sheet folding instruction.

Copying processing of performing document reading and then Z-folding has been described with reference to FIG. 21, but the present invention is not limited to this. Z-folding processing can be optimized even for image data input from a host computer or the like. In this case, the controller 110 suffices to determine in step S2103 whether all image data included in the job have been output, and read out image data of the next page in step S2104. In step S2106, the controller 110 suffices to determine whether the sizes of output print sheets are different.

Even when Z-folding sheets of a plurality of sizes at once, the above-described embodiment prepares a mode in which a sheet size subjected to Z-folding is automatically determined and a mode in which the user can individually set a sheet size subjected to Z-folding. This can improve user operability, and the user can obtain an output result he wants.

The above-described embodiment has disclosed a configuration in which the controller 110 controls the system 100 to be able to process a job of the first type requiring print media of different sizes in print processing of one set. Print processing of one set is synonymous with print processing of one bundle and print processing of one copy. The print medium is synonymous with a sheet and print sheet. In the embodiment, a job of the first type is also called a mixed size job.

In the above-described control example, a typical example of the mixed size job is a job requiring sheets of different sizes, i.e., a sheet of the first size and a sheet of the second size corresponding to a sheet of a size different from the first size in print processing of one set by the print unit 310.

An example of this job is a job requiring a plurality of sheets including a sheet having the A3 size of 297 mm×420 mm and a sheet having the A4 size of 297 mm×210 mm corresponding to a sheet of a size smaller than the A3-size sheet. Another example is a job requiring a plurality of sheets including a sheet having the LGL size of 216 mm×356 mm and a sheet having the LTR size of 216 mm×280 mm corresponding to a sheet of a size smaller than the LGL-size sheet. These jobs have been described as typical examples of the mixed size job in the above-described embodiment.

The above-described embodiment has disclosed a configuration in which the controller 110 controls the system 100 to be able to process a job of the second type requiring print media of the same size in print processing of one set. In the embodiment, a job of the second type is also called an equal-size job.

An example of this job is a job in which all sheets necessary for print processing of one set are sheets having the A4 size of 297 mm×210 mm. Another example is a job in which all sheets necessary for print processing of one set are sheets having the LTR size of 216 mm×280 mm. These jobs have been described as typical examples of the equal-size job in the above-described embodiment.

In the embodiment, on the premise of this configuration, assume that a job to be processed by the system 100 is a mixed size job corresponding to a job of the first type. In this case (to be referred to as the first case hereinafter), the controller 110 inhibits the C/Z-folding unit 820 from folding a sheet of the second size necessary for print processing of one set of the mixed size job.

In the first case, the controller 110 permits the C/Z-folding unit 820 to fold a sheet of the first size necessary for print processing of one set of the mixed size job. That is, the controller 110 inhibits folding a sheet of the second size necessary for print processing of one set of the job of the first type, but permits folding a sheet of the first size necessary for print processing of one set of the job of the first type.

The controller 110 enables the system 100 to Z-fold a sheet having undergone print processing of a target mixed size job, like the above-mentioned control example.

By this control, the system 100 can create a final product by Z-folding sheets of a large size without Z-folding sheets of a small size in one set of printed materials including sheets of the large and small sizes.

Assume that a job to be processed by the system 100 is an equal-size job corresponding to a job of the second type. In this case (to be referred to as the second case hereinafter), the controller 110 permits the C/Z-folding unit 820 to fold a sheet of the second size necessary for print processing of one set of the equal-size job. The controller 110 enables the system 100 to Z-fold a sheet having undergone print processing of a target equal-size job, like the above-mentioned control example.

By this control, the system 100 can create a final product by Z-folding sheets of a small size in one set of printed materials including only sheets of the small size.

As described in these control examples, the embodiment puts importance on user intention as much as possible when determining whether to Z-fold a sheet. For example, as described in the embodiment, whether to Z-fold a sheet having undergone print processing of a target job is determined in accordance with a user request from the user interface unit in the embodiment. This control can be executed regardless of whether the target job is a mixed size job or equal-size job.

Assume that the target job is a job of the first type. In the first case, the controller 110 inhibits folding a sheet of the second size necessary for print processing of one set of a job of the first type, but permits folding a sheet of the first size necessary for print processing of one set of the job of the first type in accordance with a user request from the user interface unit.

This control is executed when the user requests execution of Z-folding processing as post-processing to a mixed size job.

Assume that the type of post-processing which needs to be executed in a mixed size job requested by the user is Z-folding processing. In this case, the controller 110 causes the system 100 to execute folding processing to the job. Z-folding processing is a specific type of folding processing of making the size of a folded sheet in the mixed size job coincide with the second size of an unfolded sheet in the job.

According to the embodiment, the controller 110 determines that the target job is a mixed size job (job of the first type) on condition that the user has selected the "mixed size originals" key 1401 as a setting of the print conditions of the target job. This determination corresponds to a case where YES in S2106. To the contrary, the controller 110 determines that the target job is an equal-size job (job of the second type) on condition that the user has not selected the "mixed size originals" key 1401. This determination corresponds to a case where NO in S2106. The embodiment has disclosed this configuration. That is, the embodiment has disclosed the configuration in which the controller 110 determines, based on an explicit instruction from the user as a criterion, whether the target job is a mixed size job (job of the first type) or an equal-size job (job of the second type). However, the embodiment is not limited to this configuration.

For example, the document size sensor of the reading section 200 detects, for each document sheet, the sizes of document data of pages in one print job. If it is determined that the document data of pages in the job include data of different document sizes, the controller 110 determines that the job is a mixed size job (job of the first type). If it is determined that the document data of pages in the job do not include data of different document sizes and all the data have the same document size, the controller 110 determines that the job is an equal-size job (job of the second type).

In the above-mentioned configuration, the mixed size job (job of the first type) is a job in which print media of different sizes coexist as print media necessary for print processing of one set of an actual target job. In contrast, the equal-size job (job of the second type) is a job in which print media of different sizes do not coexist as print media necessary for print processing of one set, and print media all having the same size are used. In this manner, this configuration depends on print media for actual use. The embodiment further discloses a configuration in which the controller 110 determines print media necessary for print processing of a target job by, e.g., the following method.

In this configuration, for example, the user explicitly designates print media for use in a target job via the user interface unit regardless of the document size of the target job. In this case, for example, the controller 110 determines the size and type of print media and print processing to be executed by the system 100 on the basis of an explicit instruction from the user.

As another method, the user does not explicitly designate the size of print media necessary for print processing. In this case, for example, the controller 110 causes the document size sensor to detect document sizes of a target job one by one. If the detected document size is A4, the controller 110 automatically determines print media of a size coincident with the A4 document size, i.e., A4 print media as print media necessary to print the document. In this way, the controller 110 determines one by one the sizes of print media necessary for print processing of one set of a job on the basis of the sizes of document sheets to be processed in the job without accepting an explicit instruction concerning the print medium size from the user. This case corresponds to a configuration in which the controller 110 operates the system 100 in the automatic paper selection mode.

As described above, the embodiment includes the configuration in which the controller 110 specifies print media necessary for print processing of one set of a target job on the basis of an explicit instruction from the user. The embodiment also includes the configuration in which the controller 110 specifies print media necessary for print processing of one set of a target job on the basis of the document size without any instruction from the user to specify the sizes of print media.

Although various control examples have been described, the present invention incorporates all configurations which satisfy at least the following constituent features.

For example, a sheet of the second size is a sheet of a size smaller than a sheet of the first size.

Assume that a job to be processed by the system 100 is a mixed size job which corresponds to a job of the first type and in which sheets necessary for print processing of one set include a sheet of the first size and a sheet of the second size. In this case, the controller 110 inhibits the system 100 from folding a sheet of the second size in the mixed size job.

Assume that a job to be processed by the system 100 is an equal-size job which corresponds to a job of the second type and in which all sheets necessary for print processing of one set are sheets of the second size. In this case, the controller 110 permits the system 100 to fold sheets of the second size in the equal-size job.

In other words, these constituent features fall within the following configuration.

More specifically, assume that a job to be processed by the system 100 is a job of the first type (mixed size job). In this case, the controller 110 permits executing a specific type of post-processing, i.e., Z-folding processing one by one to sheets corresponding to sheets of the first size out of sheets necessary for print processing of one set of the job. In the embodiment, Z-folding processing serving as the specific type of post-processing is called the first type of post-processing. Also in this case, the controller 110 inhibits executing the first type of post-processing to sheets corresponding to sheets of the second size out of sheets necessary for print processing of one set of the job. That is, in this case, the controller 110 inhibits executing, to sheets of the second type necessary for print processing of one set of the job, post-processing of the same type as post-processing permitted to be executed to sheets of the first type necessary for print processing of one set of the job.

Assume that a job to be processed by the system 100 is a job of the second type (equal-size job). In this case, the controller 110 permits executing Z-folding processing serving as the specific type of post-processing one by one to sheets of the second size necessary for print processing of one set of the job.

More specifically, the controller 110 controls to permit executing Z-folding processing serving as the specific type of post-processing to sheets of the first size in a job of the first type, and inhibit executing it to sheets of the second size in the job of the first type. However, the controller 110 permits executing, to sheets of the second size in a job of the second type, the post-processing which is inhibited to sheets of the second size in a job of the first type.

The above-described Z-folding processing is post-processing executed for at least a specific number of sheets necessary for print processing of one set. The embodiment has disclosed the configuration in which sheets can be Z-folded one by one. However, the embodiment may also adopt a configuration in which two sheets are Z-folded when print processing of one set requires 10 sheets.

The embodiment has exemplified the Z-folding processing as a specific type of folding processing which makes the size of a folded sheet having the first size coincide with that of an unfolded sheet having the second size. However, the size of a folded sheet having the first size need not always coincide with that of an unfolded sheet having the second size. When at least binding sheets of large and small sizes into one, a sheet of a large size is folded to be smaller in size than an unfolded sheet of a small size. In this fashion, the present invention incorporates all folding processes of, for example, when binding sheets of large and small sizes into one, providing a proper form the user wants without creating an improper output result in which sheets of the large size extend from those of the small size.

As a job of the second type, the embodiment has exemplified a job requiring only a sheet of the second type corresponding to a sheet of a size smaller than a sheet of the first type. However, the embodiment may employ a configuration in which a job of the second type includes even a job requiring only a sheet of the first type in print processing of one set.

Assume that the target job is a job requiring sheets all having the same A3 size in print processing of one set. In this case, the controller 110 controls to permit Z-folding each A3-size sheet of the job. Also, assume that the target job is a job requiring sheets all having the same legal size in print processing of one set. In this case, the controller 110 controls to permit Z-folding each legal-size sheet of the job.

As described above, assume that the target job is a job requiring sheets all having the same large size in print processing of one set. In this case, the controller 110 controls to be able to execute Z-folding processing serving as the specific type of post-processing to large-size sheets of the job.

Further, assume that the target job is a job requiring sheets all having the same small size in print processing of one set. Also in this case, the controller 110 controls to be able to execute Z-folding processing serving as the specific type of post-processing to small-size sheets of the job. This has been described in the embodiment.

More specifically, assume that the target job is a job requiring only sheets all having the same A4 size in print processing of one set. In this case, the controller 110 controls to permit Z-folding each A4-size sheet of the job. Also, assume that the target job is a job requiring only sheets all having the same letter size in print processing of one set. In this case, the controller 110 controls to permit Z-folding each letter-size sheet of the job.

A variety of configurations as described above also fall within control examples to a job of the second type corresponding to an equal-size job. The system 100 is configured to be able to execute at least control to a job of the first type corresponding to the mixed size job.

Assume that the target job is a job requiring sheets of different sizes including sheets of large and small sizes in print processing of one set. In this case, the controller 110 controls to permit executing Z-folding processing to large-size sheets of the job. However, in this case, the controller 110 controls to inhibit executing, to small-size sheets of the job, Z-folding processing which is permitted to be executed to large-size sheets of the job.

The embodiment discloses a configuration including even these constituent features.

The controller 110 controls the system 100 to permit executing the second type of post-processing different from the first type of post-processing regardless of whether the target job is a job of the first type or a job of the second type. The second type of post-processing is post-processing executed for one set to bind sheets of one set into a bundle, such as stapling processing, sorting processing, or glue binding processing (e.g., case binding processing or pad binding processing). This configuration includes, e.g., the following constituent features. As the premise of this configuration, the system 100 can execute such post-processing independently of Z-folding processing in response to an instruction from the user.

Assume that the target job is a job of the first type requiring sheets of different sizes including a sheet of the first type and a sheet of the second type in print processing of one set. In this case, the controller 110 controls to inhibit executing, to a sheet of the second type out of sheets of one set, the first type of post-processing which is permitted to be executed to a sheet of the first type out of sheets of one set. However, in processing the job of the first type, the controller 110 permits executing stapling processing of stapling sheets of the first and second types into a sheet bundle of one set. Stapling processing is post-processing executed to a sheet bundle of one set.

Assume that the target job is a job of the second type requiring only sheets of the second type in print processing of one set. In this case, the controller 110 controls to permit executing the first type of post-processing to each sheet of one set. In addition, the controller 110 also permits executing stapling processing of stapling sheets of the second type into a sheet bundle of one set. Stapling processing is post-processing executed to a sheet bundle of one set.

As described above, the controller 110 controls the system 100 to execute a specific type of post-processing of binding sheets of one set into a bundle, such as stapling processing, sorting processing, or glue binding processing. The specific type of post-processing corresponds to the second type of post-processing different from the first type of post-processing, i.e., Z-folding processing. On the premise of this, the controller 110 permits executing the second type of post-processing to sheets of a target job regardless of whether the target job is a job of the first type or a job of the second type. The controller 110 executes the following control in accordance with an instruction from the user.

Assume that the target job is a mixed size job. In this case, the controller 110 executes Z-folding sheets of a large size in the job, and inhibits Z-folding sheets of a small size in the job. Further, the controller 110 causes the system 100 to execute post-processing of binding Z-folded large-size sheets of the job and unfolded small-size sheets of the job into a bundle of sheets of one set of the job.

Assume that the target job is an equal-size job. In this case, the controller 110 executes Z-folding each sheet of the same size necessary for print processing of one set of the job in accordance with an instruction from the user. Then, the controller 110 causes the system 100 to execute post-processing of binding Z-folded sheets of the job into a bundle of sheets of one set of the job.

In this manner, regardless of whether the target job is a mixed size job or equal-size job, post-processing independent of Z-folding processing can be executed based on an instruction from the user via the user interface unit of the embodiment to execute the post-processing.

This control can further enhance the effects disclosed in the embodiment to meet a variety of needs from the user in association with post-processing without causing any trouble.

The system 100 having various constituent features can attain, e.g., the following effects.

For example, the embodiment can establish an output environment where folding processing the user wants can be executed even when sheets of a plurality of sizes coexist. For example, the system 100 can satisfy a need to fold a sheet in a certain case, folding of which is inhibited in another case. The system 100 can provide a mechanism capable of flexibly meeting various needs from the user in association with folding processing to sheets.

In the embodiment, the printing apparatus of the system 100 incorporates the controller 110, but the present invention is not limited to this. For example, a finisher connectable to the printing apparatus of the system 100 may incorporate a controller which executes all or some of control operations that are executed by the controller 110 in the embodiment. An external apparatus which transmits print data to the printing apparatus of the system 100 may also incorporate a controller.

Other Embodiments

Although the embodiment of the present invention has been described in detail, the present invention is also applicable to a method of controlling a folding unit which performs folding other than Z-folding. The present invention is not limited to a method of controlling a sheet folding unit combined with a copying machine or printer, but is also applicable to a control method by the controller of a single sheet folding unit.

The embodiment of the present invention has been described in detail. The present invention may also be applied to a system including a plurality of devices or an apparatus formed by a single device.

The present invention is also achieved by supplying a program for implementing the functions of the above-described embodiment to a system or apparatus directly or from a remote place, and reading out and executing the supplied program codes by the system or apparatus. Hence, the program codes installed in a computer in order to implement functional processing of the present invention by the computer also fall within the technical scope of the present invention.

In this case, the program form is arbitrary such as an object code, a program executed by an interpreter, or script data supplied to an OS as long as a program function is attained.

The recording medium for supplying the program includes a Floppy® disk, hard disk, optical disk, and magnetooptical disk. The recording medium also includes a MO, CD-ROM, CD-R, CD-RW, magnetic tape, nonvolatile memory card, ROM, and DVD (DVD-ROM and DVD-R).

As another use method, the program according to the present invention or a file including an automatic installing function can also be downloaded to a recording medium such as a hard disk by connecting a client PC to an Internet site via the browser of the client PC. It is also possible to group program codes which form the program of the present invention into a plurality of files, and download the files from different homepages. That is, a WWW server which allows a plurality of users to download the program for implementing functional processing of the present invention by a computer also falls within the scope of the present invention.

The program according to the present invention may also be encrypted, stored in a storage medium such as a CD-ROM, and distributed to a user. A user who satisfies predetermined conditions is prompted to download decryption key information from a homepage via the Internet. The user can execute the encrypted program using the key information, and install the program in the computer.

The functions of the above-described embodiment can also be implemented when an OS or the like running on the computer performs some or all of actual processes on the basis of the instructions of the program.

The present invention may also include a case where the program according to the present invention is written in the memory of the function expansion unit of a PC, and the CPU of the function expansion unit or the like executes some or all of actual processes on the basis of the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-006419 filed on Jan. 15, 2007, which is hereby incorporated by reference herein in its entirety.

The invention claimed is:

1. A printing system being capable of executing a folding processing for both a sheet having a first size and a sheet having a second size that is larger than the first size, the system comprising:

a reading unit configured to read an image of an original;

a printing unit configured to execute a printing processing based on the image of the original read by the reading unit;

a folding unit configured to execute the folding processing for the sheet for which the printing processing is executed by the printing unit; and a reception unit configured to receive, from a user, an execution instruction for the folding processing, wherein the folding unit does not execute the folding processing for the sheet for which the printing processing has been executed in a case where the reception unit does not receive the execution instruction for the folding processing, wherein the folding unit executes the folding processing for the sheet for which the printing processing has been executed based on the image of the original having the first size at least in a case where the reception unit receives the execution instruction for the folding processing and all originals are originals having the first size, and wherein the folding unit executes the folding processing for the sheet for which the printing processing has been executed based on the image of the original having the second size and does not execute the folding processing for the sheet for which the printing processing has been executed based on the image of the original having the first size in a case where the reception unit receives the execution instruction for the folding processing and the originals include an original having the first size and an original having the second size.

2. The printing system according to claim 1, wherein the first size is an A4 size and the second size is an A3 size.

3. The printing system according to claim 1, wherein the first size is a LTR size and the second size is a LGL size.

4. The printing system according to claim 1, wherein the folding processing is Z-folding processing.

5. The printing system according to claim 1, further comprising a displaying unit configured to display a setting screen on which the user inputs the execution instruction of the folding processing to the printing system, wherein the reception unit receives the execution instruction of the folding processing from the user via the setting screen.

6. A method for a printing system being capable of executing a folding processing for both a sheet having a first size and a sheet having a second size that is larger than the first size, the method comprising:

reading an image of an original with a reading unit;

executing a printing processing with a printing unit based on the image of the original read by the reading unit;

executing the folding processing with a folding unit for the sheet for which the printing processing is executed by the printing unit; and receiving with a reception unit, from a user, an execution instruction for the folding processing, wherein the folding processing is not executed by the folding unit for the sheet for which the printing processing has been executed in a case where the execution instruction for the folding processing is not received by the reception unit, wherein the folding processing is executed by the folding unit for the sheet for which the printing processing has been executed based on the image of the original having the first size at least in a case where the execution instruction for the folding processing is received by the reception unit and all originals are originals having the first size, and wherein the folding processing is executed by the folding unit for the sheet for which the printing processing has been executed based on the image of the original having the second size and the folding processing is not executed for the sheet for which the printing processing has been executed based on the image of the original having the first size in a case where the execution instruction for the folding processing is received by the reception unit and the originals include an original having the first size and an original having the second size.

7. A non-transitory computer-readable storage medium storing a computer program for executing on a computer a method for a printing system being capable of executing a folding processing for both a sheet having a first size and a sheet having a second size that is larger than the first size, the method comprising:

reading an image of an original with a reading unit;

executing a printing processing with a printing unit based on the image of the original read by the reading unit;

executing the folding processing with a folding unit for the sheet for which the printing processing is executed by the printing unit; and receiving with a reception unit, from a user, an execution instruction for the folding processing, wherein the folding processing is not executed by the folding unit for the sheet for which the printing processing has been executed in a case where the execution instruction for the folding processing is not received by the reception unit, wherein the folding processing is executed by the folding unit for the sheet for which the printing processing has been executed based on the image of the original having the first size at least in a case where the execution instruction for the folding processing is received by the reception unit and all originals are originals having the first size, and wherein the folding processing is executed by the folding unit for the sheet for which the printing processing has been executed based on the image of the original having the second size and the folding processing is not executed for the sheet for which the printing processing has been executed based on the image of the original having the first size in a case where the execution instruction for the folding processing is received by the reception unit and the originals include an original having the first size and an original having the second size.

8. A printing system being capable of executing a folding processing for both a sheet having a first size and a sheet having a second size that is larger than the first size, the system comprising:

a printing unit configured to execute a printing processing on a sheet;

a folding unit configured to execute the folding processing for the sheet for which the printing processing is executed by the printing unit;

a first reception unit configured to receive, from a user, an execution instruction for the folding processing; and a determination unit configured to, in a case where a sheet has the first size, determine whether or not the folding processing is to be executed for the sheet, based on information associated with a size being different from the execution instruction, wherein the folding unit does not execute the folding processing for the sheet for which the printing processing has been executed in a case where the first reception unit does not receive the execution instruction, wherein the folding unit executes the folding processing for the sheet having the first size in a case where the first reception unit receives the execution instruction and the determination unit determines that the folding processing is executed for the sheet having the first size, wherein the folding unit does not execute the folding processing for the sheet having the first size in a case where the first reception unit receives the execution instruction and the determination unit determines that the folding processing is not executed for the sheet having the first size, wherein the folding unit executes the folding processing for both the sheet having the first size and the sheet having the second size in a case where the first reception unit receives the execution instruction, the sheet for which the folding processing is executed includes both the sheet having the first size and the sheet having the second size, and the determination unit determines that the folding processing is executed for the sheet having the first size, and wherein the folding unit does not execute the folding processing for both the sheet having the first size and the sheet having the second size in a case where the first reception unit receives the execution instruction, the sheet for which the folding processing is executed includes both the sheet having the first size and the sheet having the second size, and the determination unit determines that the folding processing is not executed for the sheet having the first size.

9. The printing system according to claim 8, wherein the determination unit determines, based on information indicating a mixed size, whether or not the folding processing is executed for the sheet having the first size.

10. The printing system according to claim 9, wherein the printing unit executes the printing processing based on the print job, and the determination unit determines that the folding processing is executed for the sheet having the first size in a case where the print job does not include the information indicating the mixed size, and determines that the folding processing is not executed for the sheet having the first size in a case where the print job includes the information indicating the mixed size.

11. The printing system according to claim 8, further comprising:

a second reception unit configured to receive a mixed size designation from a user, wherein the determination unit determines that the folding processing is executed for the sheet having the first size in a case where the second reception unit does not receive the mixed size designation, and determines that the folding processing is not executed for the sheet having the first size in a case where the second reception unit receives the mixed size designation.

12. The printing system according to claim 8, wherein the first size is an A4 size and the second size is an A3 size.

13. The printing system according to claim 8, wherein the first size is a LTR size and the second size is a LGL size.

14. The printing system according to claim 8, wherein the folding processing is Z-folding processing.

15. A printing method being capable of executing a folding processing for both a sheet having a first size and a sheet having a second size that is larger than the first size, the method comprising:

a printing step configured to execute a printing processing on a sheet;

a folding step configured to execute the folding processing for the sheet for which the printing processing is executed by the printing unit;

a first reception step configured to receive, from a user, an execution instruction for the folding processing; and a determining step configured to, in a case where a sheet has the first size, determine whether or not the folding processing is to be executed for the sheet, based on information associated with a size being different from the execution instruction, wherein the folding step does not execute the folding processing for the sheet for which the printing processing has been executed in a case where the first reception step does not receive the execution instruction, wherein the folding step executes the folding processing for the sheet having the first size in a case where the first reception step receives the execution instruction and the determining step determines that the folding processing is executed for the sheet having the first size, wherein the folding step does not execute the folding processing for the sheet having the first size in a case where the first reception step receives the execution instruction and the determining step determines that the folding processing is not executed for the sheet having the first size, wherein the folding step executes the folding processing for both the sheet having the first size and the sheet having the second size in a case where the first reception step receives the execution instruction, the sheet for which the folding processing is executed includes both the sheet having the first size and the sheet having the second size, and the determining step determines that the folding processing is executed for the sheet having the first size, and wherein the folding step does not execute the folding processing for both the sheet having the first size and the sheet having the second size in a case where the first reception step receives the execution instruction, the sheet for which the folding processing is executed includes both the sheet having the first size and the sheet having the second size, and the determining step determines that the folding processing is not executed for the sheet having the first size.

16. A non-transitory computer-readable storage medium storing a computer program for executing on a computer a method for a printing system being capable of executing a folding processing for both a sheet having a first size and a sheet having a second size that is larger than the first size, the method comprising:

a printing step configured to execute a printing processing on a sheet;

a folding step configured to execute the folding processing for the sheet for which the printing processing is executed by the printing unit;

a first reception step configured to receive, from a user, an execution instruction for the folding processing; and a determining step configured to, in a case where a sheet has the first size, determine whether or not the folding processing is to be executed for the sheet, based on information associated with a size being different from the execution instruction, wherein the folding step does not execute the folding processing for the sheet for which the printing processing has been executed in a case where the first reception step does not receive the execution instruction, wherein the folding step executes the folding processing for the sheet having the first size in a case where the first reception step receives the execution instruction and the determining step determines that the folding processing is executed for the sheet having the first size, wherein the folding step does not execute the folding processing for the sheet having the first size in a case where the first reception step receives the execution instruction and the determining step determines that the folding processing is not executed for the sheet having the first size, wherein the folding step executes the folding processing for both the sheet having the first size and the sheet having the second size in a case where the first reception step receives the execution instruction, the sheet for which the folding processing is executed includes both the sheet having the first size and the sheet having the second size, and the determining step determines that the folding processing is executed for the sheet having the first size, and wherein the folding step does not execute the folding processing for both the sheet having the first size and the sheet having the second size in a case where the first reception step receives the execution instruction, the sheet for which the folding processing is executed includes both the sheet having the first size and the sheet having the second size, and the determining step determines that the folding processing is not executed for the sheet having the first size.

* * * * *